US006629691B2

(12) United States Patent
Niiyama et al.

(10) Patent No.: US 6,629,691 B2
(45) Date of Patent: Oct. 7, 2003

(54) PAPER-LEAVES CONVEYING APPARATUS

(75) Inventors: Yuichi Niiyama, Kawasaki (JP); Akira Shimasaki, Yokohama (JP); Akihiko Nakamoto, Yokohama (JP); Nobuo Shibata, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 46 days.

(21) Appl. No.: 09/822,464

(22) Filed: Apr. 2, 2001

(65) Prior Publication Data

US 2002/0153652 A1 Oct. 24, 2002

(30) Foreign Application Priority Data

Apr. 3, 2000 (JP) ..... 2000-101631
Apr. 3, 2000 (JP) ..... 2000-101635
Apr. 3, 2000 (JP) ..... 2000-101637

(51) Int. Cl.[7] ..... B65H 1/02

(52) U.S. Cl. ..... 271/2; 271/3.12; 271/129; 271/31.1; 271/149; 198/474.1; 198/479.1; 198/728

(58) Field of Search ..... 271/2, 3.12, 129, 271/31.1, 149; 198/474.1, 476.1, 479.1, 725, 728, 729

(56) References Cited

U.S. PATENT DOCUMENTS 4,523,753 A * 6/1985 Hiromori et al. ..... 271/31.1
4,789,148 A * 12/1988 Noguchi et al. ..... 271/94
5,044,877 A * 9/1991 Constant et al. ..... 414/798.9
5,993,132 A * 11/1999 Harres et al. ..... 414/416.04

FOREIGN PATENT DOCUMENTS

JP 11310336 A * 11/1999 ..... B65H/3/12
JP 2001000919 A * 1/2001 ..... B07C/3/08

* cited by examiner

*Primary Examiner*—Christopher P. Ellis
*Assistant Examiner*—Mark A. Deuble
(74) *Attorney, Agent, or Firm*—McDermott, Will & Emery

(57) ABSTRACT

In a paper-leaves conveying means for conveying a plurality of paper leaves, set together in a bundle in a depositing section, toward a paper-leaves feeding position where a separating/supplying belt exists, an arm is provided which is designed to be moved toward the paper-leaves feeding position in a protruding condition into the interior of the depositing section for supporting side surfaces of the paper leaves, and further to be retreated instantaneously from the interior of the depositing section immediately before the last paper leaf existing between the arm and the separating/supplying belt is handed over to the separating/supplying belt side. Thus, the arm can support the paper leaves until immediately before they are handed over to the separating/supplying belt, which eliminates the occurrence of the falling-down of the paper leaves at the paper-leaves feeding position. In addition, the feeding control of the paper leaves are accurately implemented by the over-press detection of the paper leaves or the thickness detection of the paper leaves.

2 Claims, 30 Drawing Sheets

PAPER-LEAVES CONVEYING APPARATUS

BACKGROUND OF THE INVENTION

1. Field of the Invention

The present invention relates to, in a paper-leaves division system for use, for example, in postal organizations or the like, a paper-leaves transferring apparatus suitably employable in separating a plurality of paper leaves such as mail, deposited together in a bundle, to convey them one by one to a partitioning section.

2. Description of the Related Art

In the recent years, a mail division apparatus, which includes a recognizing function for reading a bar-code attached to mail or a character recognizing function for reading destination information such as a postal code to divide the mail automatically on the basis of these destination information, has been put in practical use. Such a paper-leaves division apparatus, which is made to handle mail or the like (which will be referred to hereinafter to "paper leaves"), has been required to meet requirements such as space-saving, labor-saving, cost reduction and fast operation. A means to realize the fast operation of these requirements has been required to eliminate the occurrence of troubles in the middle of the conveyance and further to accomplish the conveyance and the partitioning operation more promptly and accurately.

In general, such a type of paper-leaves division apparatus is designed to separate a plurality of paper leaves to be divided, deposited together in a bundle in a stand-up condition in a depositing section and fed to a separating/supplying section, one by one and subsequently send them successively toward the downstream side. The separating/supplying section is equipped with a separating/supplying belt so that the paper leaves are carried in the stand-up condition until arriving at a contact position with the separating/supplying belt and, when reaching the separating/supplying belt position, they are almost vertically fed in an upward direction, i.e., toward the downstream side, in a state attached onto the separating/supplying belt by vacuum suction. In addition, the movement of the paper leaves from the depositing section to the separating/supplying section is accomplished by a paper-leaves conveying means equipped with an arm for supporting side surfaces of the paper leaves.

In the paper-leaves conveying means, the arm is made to protrude and retreat into/from the interior of the depositing section, and protrudes into the interior of the depositing section when the paper leaves are sent to a paper-leaves feeding position at which the separating/supplying belt lies, and supports the side surfaces of the paper leaves in that state, thus enabling the paper leaves to shift toward the paper leaves feeding position. In addition, when the paper leaves approach the paper-leaves feeding position, the arm retreats gradually. Thereafter, the paper leaves are handed over to the separating/supplying belt to be fed to the downstream side by the separating/supplying belt.

Accordingly, if the separating/supplying section cannot achieve the separation of the paper leaves properly and promptly, then this has great influence on the handling ability, for that difficulty is encountered in handling a large number of paper leaves at a high speed.

In addition, if the repeated operations such as the transfer of the paper leaves to the separating/supplying section and the separation of the paper leaves in the separating/supplying section are not conducted promptly and accurately, this has adverse effect on the subsequent address information reading accuracy and conveying/partitioning operations.

The above-mentioned paper-leaves conveying means with the conventional construction has no choice other than the arm retreating gradually as the paper leaves approach the paper-leaves feeding position, and since the arm cannot reach the separating/supplying belt in the protruding state immediately before the paper leaves come into contact with the separating/supplying belt, the paper leaves can frequently fall into an backwardly inclined condition to fall down immediately before the paper-leaves feeding position. For this reason, in order to bring the paper leaves, inclinable backwardly to fall down, into contact with the separating/supplying belt, there is a need for an operator to raise up the paper leaves at the paper-leaves feeding position or to directly support the paper leaves by hand immediately before the paper-leaves feeding position, which creates problems in safety, lowered work efficiency and increased burden on the operator. In addition, in the case of the conventional mechanism/system, when the arm retreats gradually in response to the paper leaves approaching the paper-leaves feeding position, the conveying speed reduces or gains with respect to a desired speed before the paper-leaves feeding position so that the interval of the paper leaves lengthens or shortens before the paper-leaves feeding position to deviate from a proper value. For example, in a case in which a speed for when the paper leaves are successively conveyed to the paper-leaves feeding position is higher than a speed for when the paper leaves are fed toward the downstream side at the paper-leaves feeding position, the paper leaves can jam at the paper-leaves feeding position. In such a case, the preceding paper leaves are interposed between the belt surface of the separating/supplying belt and the succeeding paper leaves conveyed afterwards, and the load to be imposed increases to make difficult the smooth feeding operation at the separating/supplying belt. The worst of it may be that simultaneous feeding of two paper leaves occurs (overlap transportation).

As mentioned above, when a large number of paper leaves are conveyed fast and consecutively, the paper leaves can be fed in an overlapped condition in the separating/supplying section or fed at a distribution-impossible interval, which may cause a trouble that a partitioning operation of the paper leaves to be conducted in the middle of the conveyance does not correctly take place. Moreover, even in a case in which the overlap transportation does not occur at that time in the separating/supplying section, the interval of the paper leaves becomes unstable during the conveyance in the paper-leaves conveying path, and the interval between one paper leaf and another subsequent paper leaf lengthens or shortens extremely, which may cause the overlap transportation of the paper leaves or the occurrence of the distribution-impossible space, thus leading to the trouble that difficulty is experienced in conducting a proper partitioning operation for the paper leaves in the middle of the conveyance. Still moreover, since the paper leaves can have arbitrary and diverse thickness, if the paper-leaves conveying means is operated at a constant speed without considering the thickness of the paper leaves, at the feeding of thick paper leaves, a large space occurs thereafter to produce a wasteful time of several seconds in the following feeding, which can lower the handling ability of the machine.

SUMMARY OF THE INVENTION

The present invention has been developed in consideration of the above-mentioned problems, and it is therefore an object of the invention to provide a paper-leaves transferring apparatus for use in a paper-leaves division system, which is capable of feeding the paper leaves smoothly without placing a full-time operator at the paper-leaves feeding position and of eliminating the work requiring the hands of the operators for improving the safety and cutting the number of persons.

Another object of the present invention is to provide a paper-leaves feeding apparatus for use in a paper-leaves division system, which is capable of feeding the paper leaves smoothly at the paper-leaves feeding position.

A further object of the present invention is to provide a paper-leaves transferring apparatus for use in a paper-leaves division system, which has a construction capable of conveying the paper leaves to the paper-leaves feeding position where the paper leaves are separated and fed one by one to the downstream side, and of conducting a prompt and proper separating/feeding operation of the paper leaves at the paper-leaves feeding position.

In accordance with the present invention, a paper-leaves transferring apparatus for use in a paper-leaves division system comprises paper-leaves conveying means for conveying a plurality of paper leaves, set together in a bundle in a depositing section, toward a paper-leaves feeding position where a separating/supplying belt is located to separate the paper leaves conveyed from each other and feed the paper leaves one by one, an arm being provided in the paper-leaves conveying means and being made to be moved toward the paper-leaves feeding position in a protruding condition into the interior of the depositing section while supporting side surfaces of the paper leaves, while being made to be retreated instantaneously from the interior of the depositing section immediately before the last paper leaf existing between the arm and the separating/supplying belt is handed over to the separating/supplying belt side. With this construction, since the paper leaves can be supported by the arm till just before the paper leaves are handed over to the separating/supplying belt, it is possible to eliminate the occurrence of the inclination and falling-down of the paper leaves immediately before the paper-leaves feeding position. This eliminates the work needed in the conventional apparatus, that is, the work of correcting the posture of the paper leaves inclined backwardly and falling down at the separating/supplying position or supporting the paper leaves by hand up to the paper-leaves feeding position, thus lightening the burden on work and avoiding the problem in safety, and further decreasing the number of full-time operators. In addition, since the arm transferring speed is maintainable at a desired speed until the arm retreats, it is possible to keep constant the density of the paper leaves existing immediately before the paper-leaves feeding position, thereby enabling smooth separation and feeding of the paper leaves and eliminating the simultaneous feeding of two paper leaves.

In addition, in the paper-leaves transferring apparatus for use in a paper-leaves division system according to the present invention, the paper-leaves conveying means includes cam means having a cam surface for controlling the protrusion/retreat of the arm and placed along a passage for the arm to the paper leaves, a partitioning arm device having a connection mechanism for maintaining the arm in a direction of the protrusion/retreat thereof and making a connection between the arm and the cam means to conduct the protrusion/retreat of the arm along the cam surface of the cam means, and conveying belt means for holding a plurality of partitioning arm devices, each corresponding to the first mentioned partitioning arm device, in a scattered condition, the conveying belt means being made to move circularly together with the partitioning arm devices for repeatedly making movement of the arm in a direction to the paper-leaves feeding position and movement of the arm in a direction separating from the paper-leaves feeding position. With this construction, the protruding/retreating operation of the arm is easily controllable through the use of the cam means and the connection mechanism.

Furthermore, in accordance with the present invention, a paper-leaves transferring apparatus for use in a paper-leaves division system comprises paper-leaves conveying means for conveying a plurality of paper leaves, set together in a bundle in a depositing section, to a paper-leaves feeding position in a stand-up condition, separating/supplying means including a separating/supplying belt made to revolve and having a belt surface positioned so that the paper leaves come successively into surface contact therewith when conveyed up to the phase-leaves feeding position and vacuum suction means for attaching the paper leaves onto a belt surface of the separating/supplying belt through the use of vacuum suction for feeding the paper leaves to the downstream side in accordance with the revolution of the separating/supplying belt, over-press detecting means for detecting the fact that the paper leaves are pressed excessively against the separating/supplying belt side at the paper-leaves feeding position, and control means for, when the over-press detecting means detects the excessively pressed condition of the paper leaves, implementing control of the paper-leaves conveying means so that the conveying direction of the paper leaves is temporarily switched to the opposite direction. With this construction, for example, at the paper-leaves feeding position, even if the paper-leaves conveying speed for when the paper leaves are conveyed to the paper-leaves feeding position is higher than the speed for when the paper leaves are fed through the separating/supplying belt, the excessively pressed condition of the preceding paper leaves against the belt surface side is detectable because, for example, the preceding paper leaves are pressed against the belt surface side by the succeeding paper leaves, and at this time the paper-leaves conveying speed by the paper-leaves conveying means is switched to the opposite direction to return the paper leaves, thereby accomplishing the feeding thereof while canceling the excessively pressed condition. Accordingly, the load the preceding paper leaves receive from the succeeding paper leaves is suppressible, thus achieving smooth feeding of the paper leaves through the separating/supplying belt at the paper-leaves feeding position.

Still furthermore, in the paper-leaves transferring apparatus for a paper-leaves division system, the paper-leaves conveying means comprises first paper-leaves conveying means having an arm for guiding the paper leaves in conveying toward the paper-leaves feeding position while supporting side surfaces of the paper leaves deposited in the depositing section and second paper-leaves conveying means for supporting lower surfaces of the paper leaves deposited in the depositing section, and the second paper-leaves conveying means includes main conveying belt means having a belt for conveying the paper leaves toward the paper-leaves feeding position in a state where the paper leaves are put thereon, and auxiliary conveying belt means provided between the main conveying belt means and the separating/supplying belt for conveying the paper leaves in forward and reverse directions. With this configuration, in order to eliminate the excessively pressed condition of the paper leaves at the paper-leaves feeding position, over-press canceling return control is implemented in a manner that only the auxiliary conveying belt means located at a position closest to the separating/supplying belt is rotationally driven in the reverse direction. That is, local control is easily executable.

Moreover, in the paper-leaves transferring apparatus for use in a paper-leaves division system according to the present invention, a belt surface of the auxiliary conveying belt means is made as a smooth surface. In this case, since the belt surface is made smooth, even if the belt is rotationally driven at a high speed to produce slipping with respect to the paper leaves, damages of the paper leaves such as peeling is preventable.

Still moreover, in the paper-leaves transferring apparatus for use in a paper-leaves division system according to the present invention, control means is provided so that the conveyance of the paper leaves by the first paper-leaves conveying means and the conveyance of the paper leaves by the main conveying belt means are stopped when the auxiliary conveying belt means is driven in the reverse direction. This signifies the division of control, which can provide an effect of canceling the over-press locally with respect to the paper leaves immediately before the separation/feeding section, and which is effective in a case in which the entire conveying section encounters the impossibility of the conveyance in the reverse direction.

In addition, a paper-leaves transferring apparatus according to the present invention comprises paper-leaves conveying means for conveying paper leaves, deposited together in a bundle through a depositing opening, to a paper-leaves feeding position in a stand-up condition, a separating/supplying section including a revolving separating/supplying belt with which the paper leaves conveyed to the paper-leaves feeding position come successively into contact so that the paper leaves are successively fed one by one to the downstream side through the revolution of the separating/supplying belt, paper-leaves thickness detecting means for detecting a thickness of the paper leaves fed from the separating/supplying section, and control means for controlling the conveyance of the paper leaves by the paper-leaves conveying means and the feeding of the paper leaves by the separating/supplying section and further for correcting the paper-leaves conveying speed of the paper-leaves conveying means on the basis of output information from the paper-leaves thickness detecting means. With this configuration, the thickness of the paper leaves fed from the paper-leaves feeding position by means of the separating/supplying belt is detected to implement feedback control for correcting, in accordance with the thickness of the paper leaves, the speed at which the paper-leaves conveying means conveys the paper leaves to the paper-leaves feeding position. This enables setting the contact force between the paper leaves to below a predetermined value at the paper-leaves feeding position to feed the paper leaves through the separating/supplying belt in a stably attached condition, which can prevent the preceding paper leaves from being excessively pressed by the succeeding paper leaves to cause the overlap transportation or can prevent the paper leaves from being fed at a distribution-impossible interval, thus achieving stable separation/supply of the paper leaves at the paper-leaves feeding position.

Still additionally, in the paper-leaves transferring apparatus according to the present invention, control means is provided so that, when the paper leaves do not arrive at the paper-leaves feeding position yet, the paper-leaves conveying means fast-conveys the paper leaves, deposited through the depositing opening, toward the paper-leaves feeding position. Since this control means fast-conveys the paper leaves to the paper-leaves feeding position when the paper leaves do not arrive at the paper-leaves feeding position, it is possible to accomplish the fast-handling which feeds the paper leaves consecutively from the paper-leaves feeding position without intermission.

BRIEF DESCRIPTION OF THE DRAWINGS

Other objects and features of the present invention will become more readily apparent from the following detailed description of the preferred embodiments taken in conjunction with the accompanying drawings.

DESCRIPTION OF THE PREFERRED EMBODIMENTS

Figure 1:
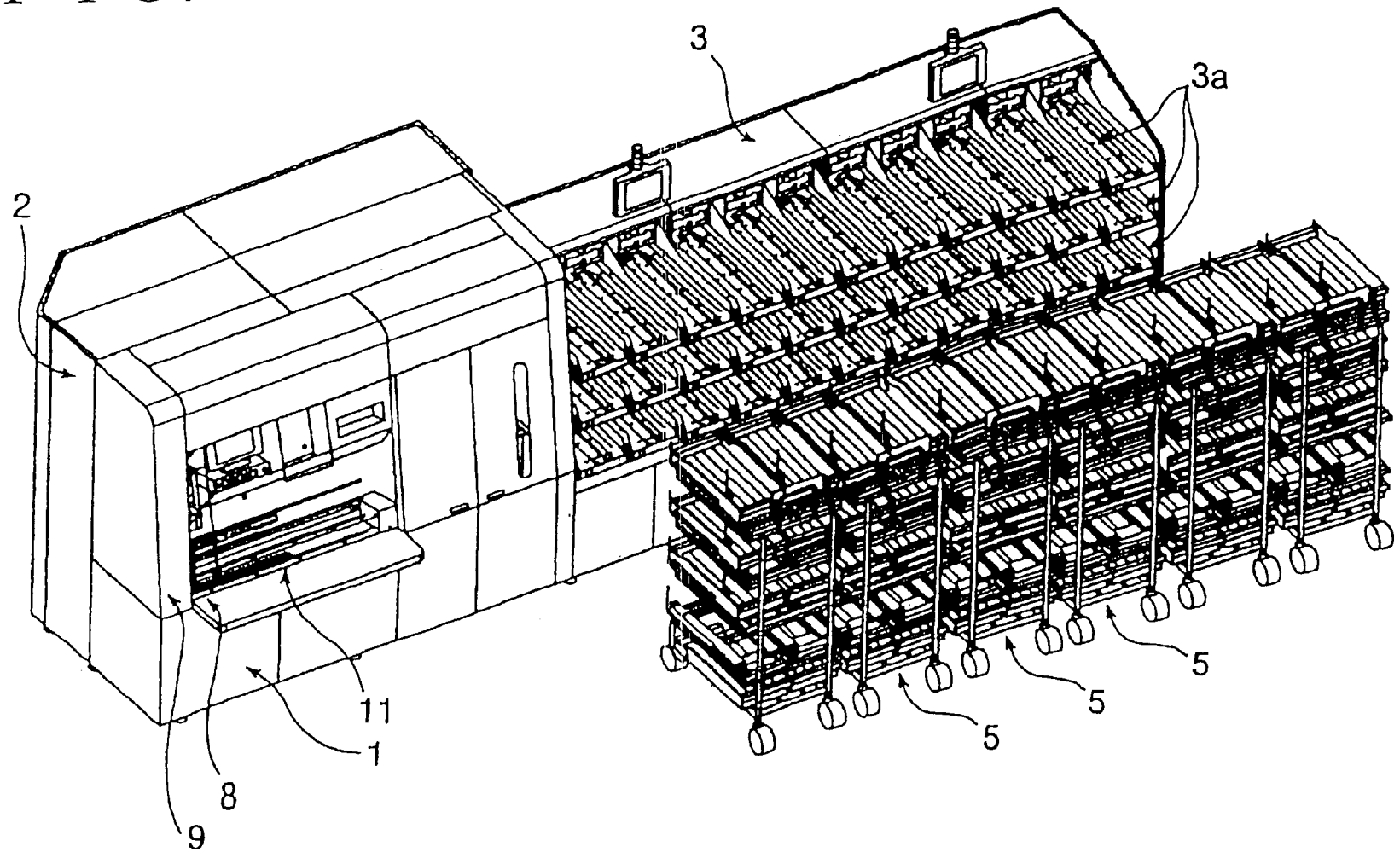
FIG. 1 is a perspective view showing the entire construction of a paper-leaves division system according to an embodiment of the present invention.

Preferred embodiments of the present invention will be described hereinbelow with reference to the drawings. FIG. 1 is a perspective view showing the entire construction of a paper-leaves division system according to the present invention, FIG. 2 is a plan view showing the entire construction of the same paper-leaves division system, and FIG. 3 is a schematic illustration of a composition of the interior of this system, viewed perceptively from a side direction.

(Outline of Entire Construction of Paper-Leaves Division System)

Figure 2:
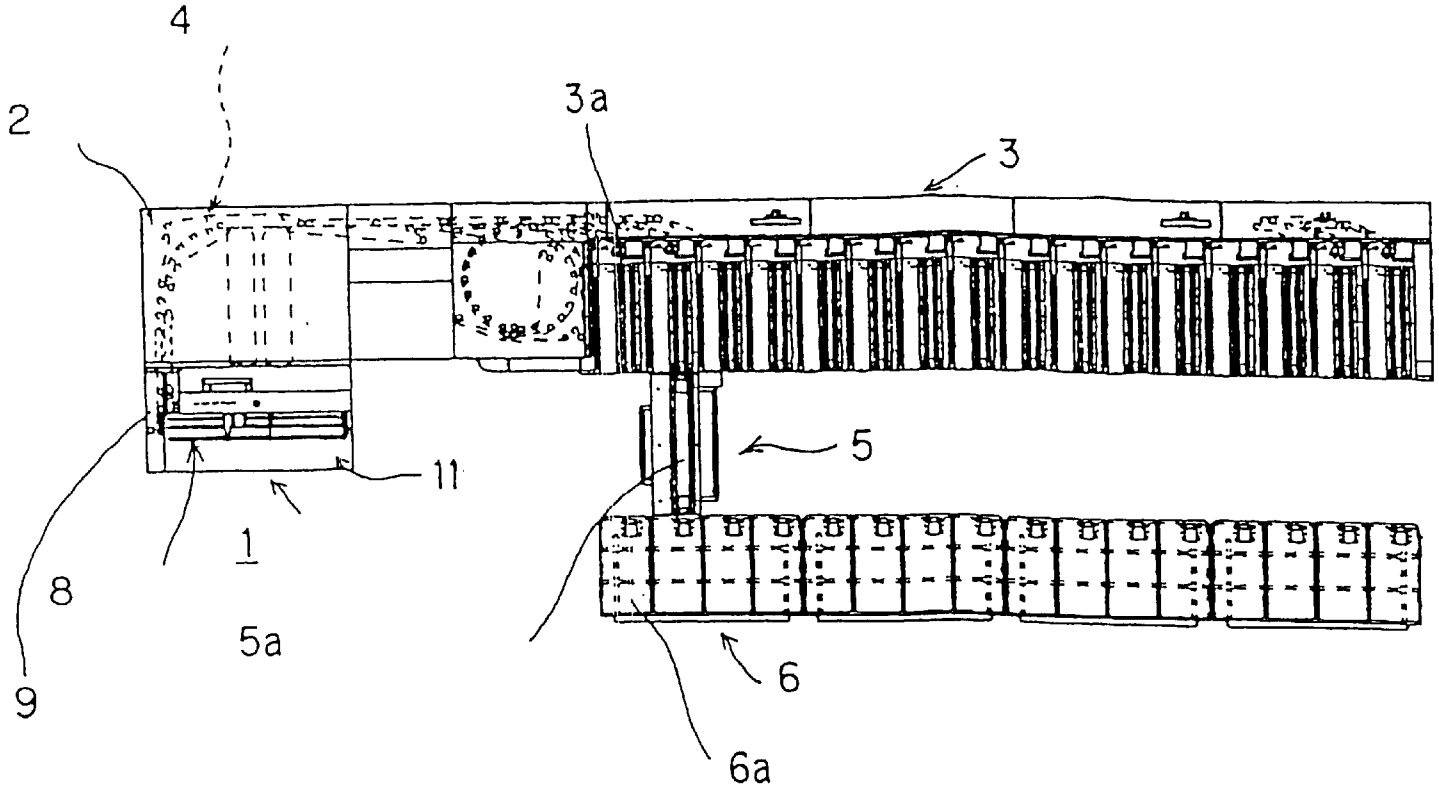
FIG. 2 is a plan view showing the entire construction of the paper-leaves division system according to this embodiment.
Figure 3:
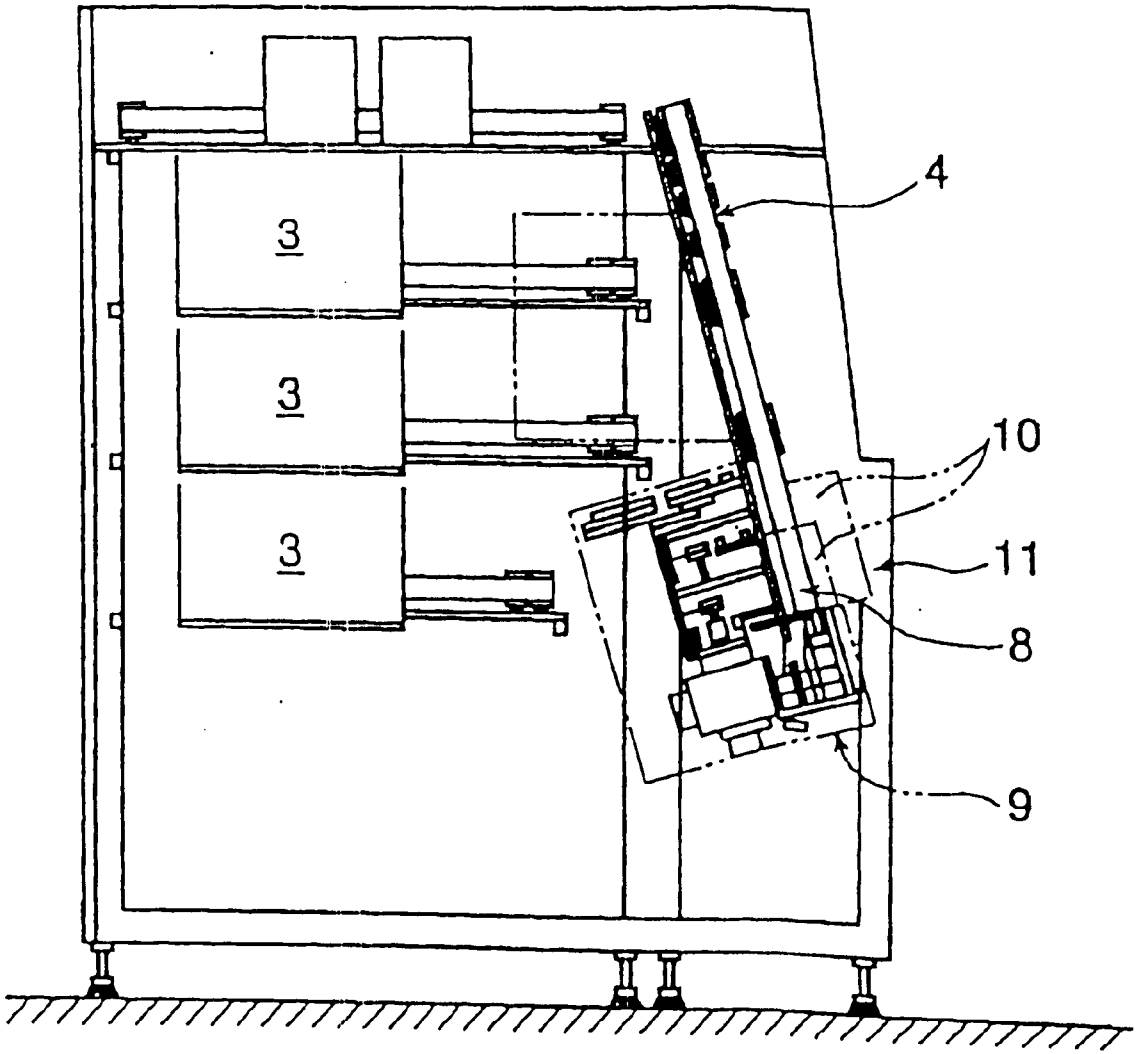
FIG. 3 is a schematic illustration of a composition of the interior of the paper-leaves division system according to the embodiment, viewed perceptively from a side direction.

In FIGS. 1 to 3, this paper-leaves division system is roughly made up of a paper-leaves supplying section 1, a reading unit 2, a paper-leaves partitioning section 3, a paper-leaves conveying means 4, a transfer truck 5, a storage shelf 6 and others.

The paper-leaves supplying section 1 is for setting a plurality of paper leaves 10 (see FIGS. 3, 20A and 20B), to be partitioned, together in a bundle and in a stand-up posture and conveying them to up a paper-leaves feeding position 8, and a paper-leaves separating/supplying apparatus 9, placed at the paper-leaves feeding position 8, separates the paper leaves 10 from each other and feeds them successively to the downstream side at which the reading unit 2 exists. The reading unit 2 reads the destination information of a bar code (alternatively, a postal code or the like) attached to each of the paper leaves 10 separated from each other in the paper-leaves separating/supplying apparatus 9, and sends that destination information to a computer.

The paper-leaves partitioning section 3, in this embodiment, is constructed into a three-step arrangement in a vertical direction. The paper-leaves partitioning section 3 includes a plurality of (in this embodiment, 33) partitioning/stacking units 3*a* for temporarily accumulating and storing the paper leaves 10 divided and distributed on the basis of the destination information, in a state aligned in a horizontal direction.

The paper-leaves conveying means 4 is for conveying the paper leaves 10, fed one by one from the paper-leaves separating/supplying apparatus 9 of the paper-leaves supplying section 1, through the reading unit 2 to the paper-leaves partitioning section 3. In the middle of the conveyance, in front of (on the upstream side of) each of the partitioning/stacking units 3*a* of the paper-leaves partitioning section 3, there is placed a distributing section (not shown) for distributing the paper leaves 10 to the partitioning/stacking units 3*a* disposed in the form of three stages.

The transfer truck 5 accepts and accommodates the paper leaves 10 discharged from the partitioning/stacking units 3*a* of the paper-leaves partitioning section 3, and a paper-leaves relaying passage 5*a*, constructed into a vertical three-step arrangement, is provided to corresponding to each of the partitioning/stacking units 3*a* of the paper-leaves partitioning section 3.

The storage shelf 6 is constructed into a vertical three-stage arrangement according to the partitioning/stacking units 3*a* of the paper-leaves partitioning section 3, wherein paper-leaves storage passages 6*a* are lined up in a horizontal direction, with each line comprising 33 paper-leaves storage passages 6*a*.

(Outline of Construction of Paper-Leaves Supplying Section 1)

Figure 4:
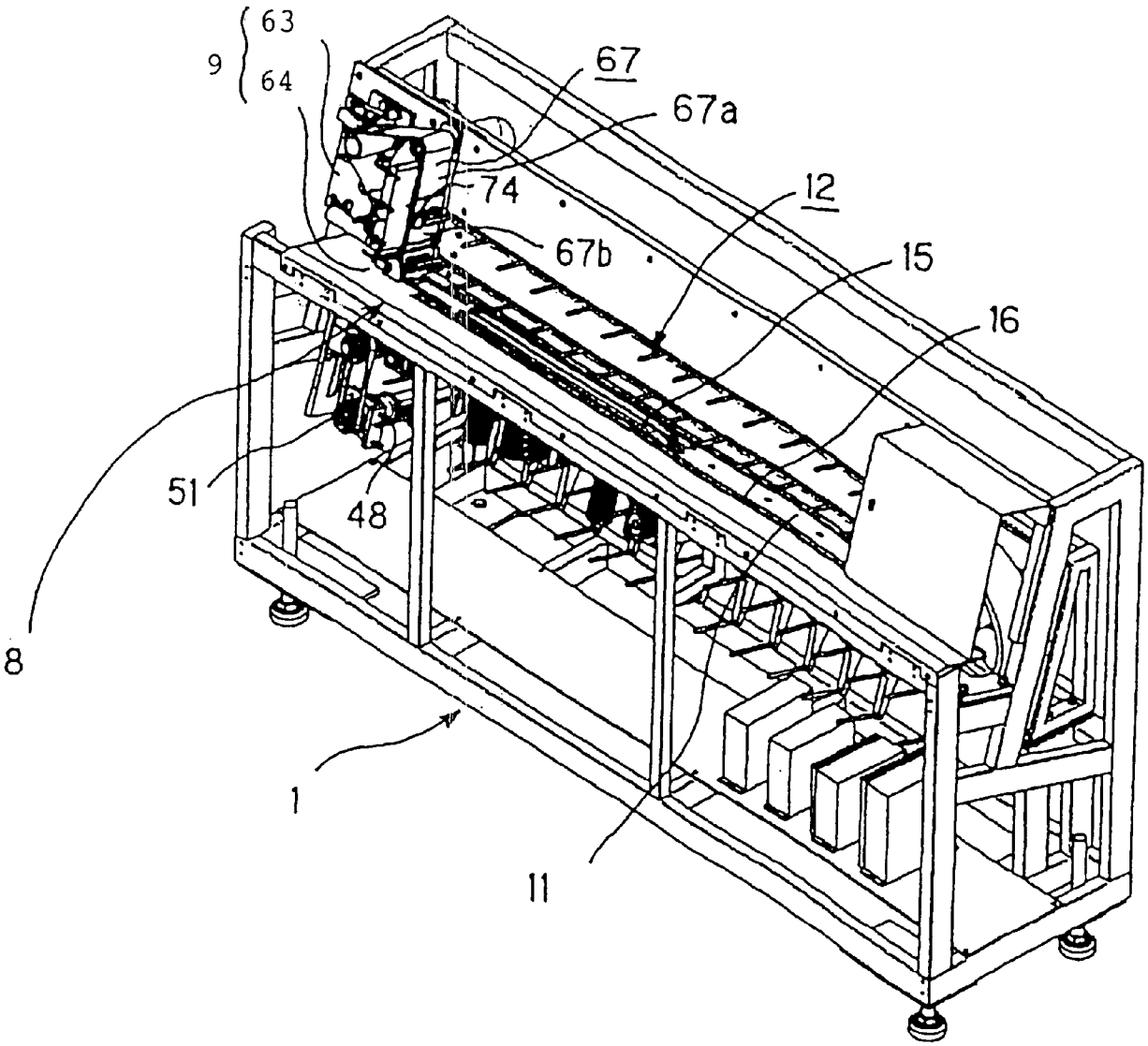
FIG. 4 is a perspective view showing an essential construction of a paper-leaves supplying section of the paper-leaves division system according to the embodiment.
Figure 5:
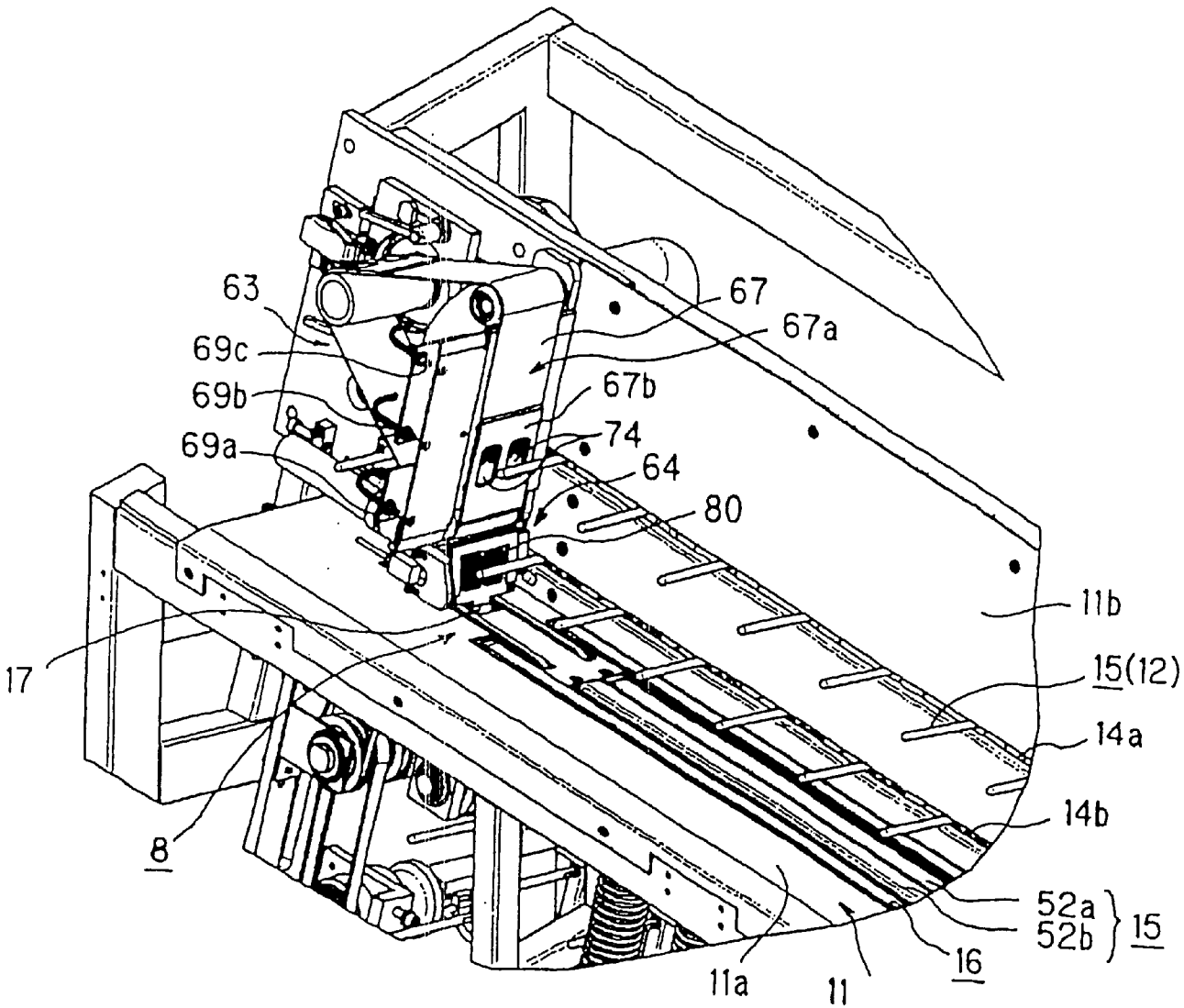
FIG. 5 is a perspective view showing an essential construction of the paper-leaves division system according to the embodiment.

FIG. 4 is a perspective view showing an essential construction of the paper-leaves supplying section 1, and FIG. 5 is an partially enlarged and perspective view showing a construction around the paper-leaves feeding position 8 in the paper-leaves supplying section 1. In FIGS. 4 and 5, the paper-leaves supplying section 1 is equipped with a depositing section 11 in which a plurality of paper leaves 10 bundled are deposited in a stand-up posture.

(Construction of Depositing Section)

Figure 6:
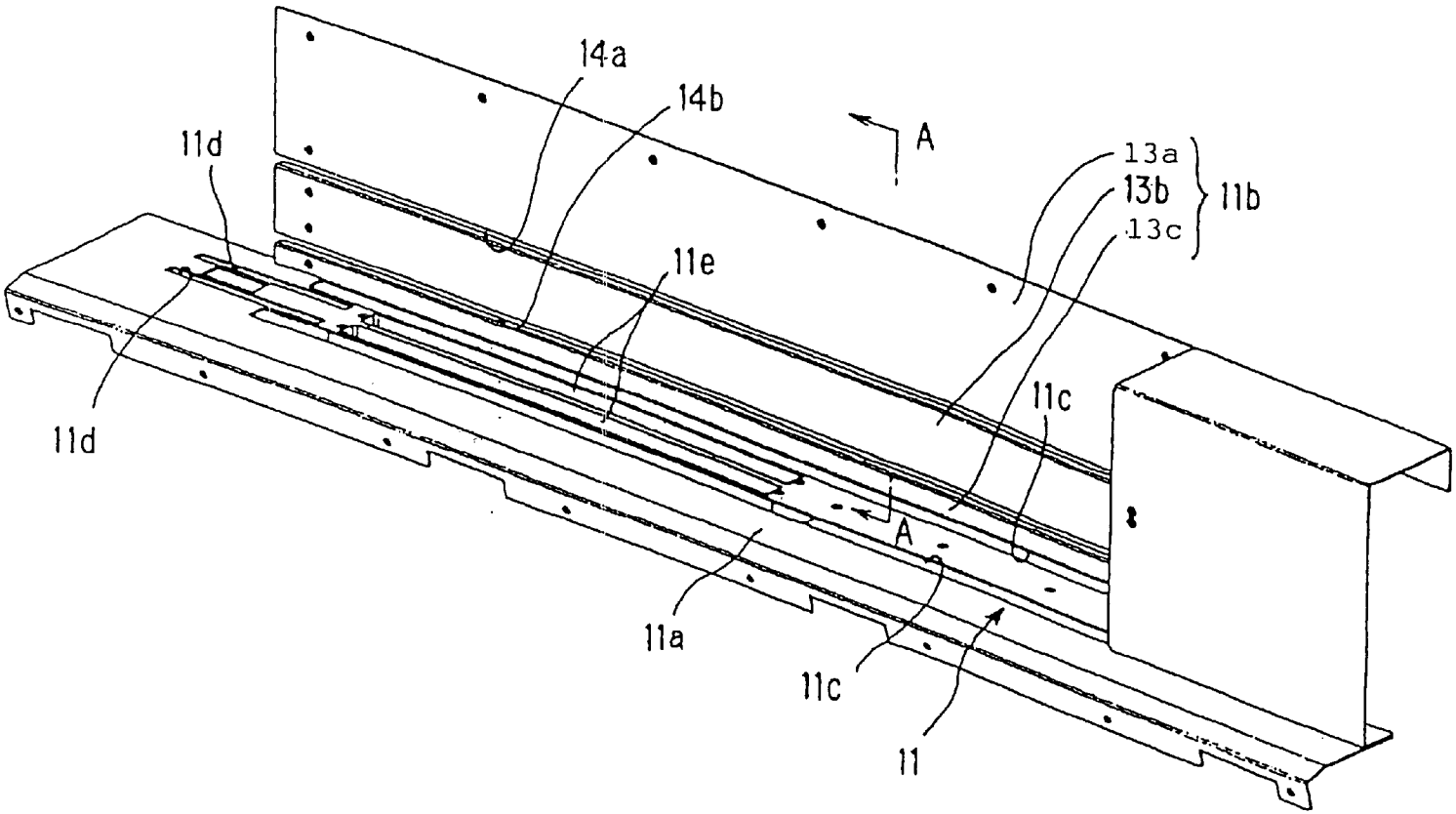
FIG. 6 is a perspective view showing an essential construction of a depositing section according to the embodiment.
Figure 7:
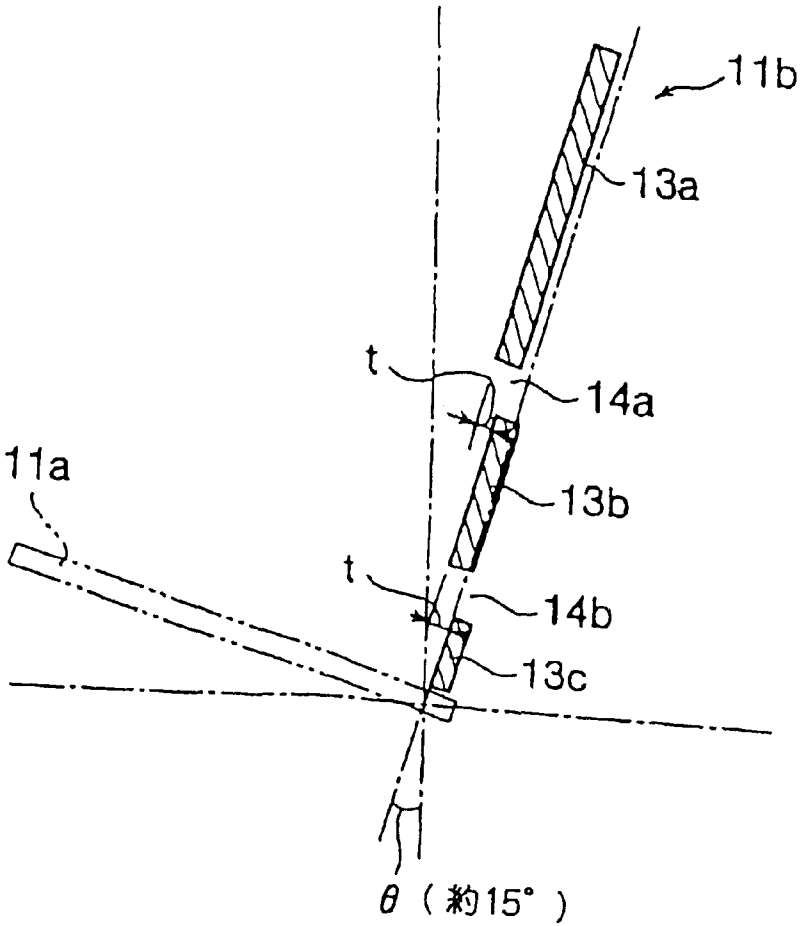
FIG. 7 is a schematic cross-sectional view taken along a line A—A of FIG. 6.

The depositing section 11, as also shown in FIGS. 6 and 7, is composed of a bottom wall 11*a* for supporting the bottom surfaces of the deposited paper leaves 10 and a back wall 11*b* for supporting the back surface portions of the paper leaves 10. The bottom wall 11*a* and the back wall 11*b* are made to intersect with each other at generally right angles to form a generally L-shaped cross section, and the entire back wall 11*b*, together with the bottom wall 11*a*, is set in a state inclined backwardly by θ degrees (approximately 15 degrees) (see FIGS. 3 and 7). FIG. 6 is a perspective view schematically showing an essential construction of the depositing section 11, and FIG. 7 is an illustrative cross-sectional view taken along a line A—A of FIG. 6.

A further description will be given hereinbelow of a peripheral structure of the depositing section 11. On the back wall 11*b* side, a paper-leaves conveying means 12 is provided which is capable of sending the paper leaves 10 (see FIG. 3) on the depositing section 11 toward the paper-leaves feeding position 8 horizontally in a stand-up condition (see FIG. 4). In addition, the back wall 11*b* is formed in a manner that three plates of an upper back plate 13*a*, an intermediate back plate 13*b* and a lower back plate 13*c* are combined into one back wall in a state where slits 14*a* and 14*b* are defined between the upper back wall 13*a* and the intermediate back plate 13*b* and between the intermediate back plate 13*b* and the lower back plate 13*c*, respectively. The back plates 13*a* to 13*c* are made to have different widths, that is, the width decreases in the order of the upper back wall 13*a*, the intermediate back plate 13*b* and the lower back wall 13*c*. Still additionally, the back plates 13*a* to 13*c* are not placed on the same plane, but are, as shown in FIG. 7, disposed stepwise so that the intermediate back plate 13*b* is slightly set backwardly by a distance t with respect to the upper back plate 13*a*, while the lower back plate 13*c* is slightly set backwardly by a distance t with respect to the intermediate back plate 11*b*, that is, so that the back wall 11*b* recedes successively as it approaches the bottom wall 11*a*. The reason that the positions of the three back plates 13*a* to 13*c* having different widths and constituting the back wall 11*b* are successively shifted rearwardly in this way is to, when the paper leaves 10 being vibrated to be put in order jump up and then drop, prevent the corners (intersections between the bottom surfaces and the back surfaces) of the paper leaves 10 from being caught by the upper surfaces of the back plates 13*b* and 13*c* defining the slits 14*a* and 14*b* to cause the paper leaves 10 to be put in disorder. That is, in a case in which the back plates 13*a* to 13*c* disposed to define the slits 14*a* and 14*b* are placed on the same plane, a protrusive step tends to be developed between the back plates 13*a*, and when the paper leaves 10 drop along the back wall 11*b* in this state, the paper leaves 10 are blocked by the protrusive step so that they turn, thereby being put in disorder. On the other hand, like this embodiment, in a case in which the back plates 13*a* to 13*c* are disposed to stepwise recede more backwardly as the position in the back wall 11*b* becomes lower, such a protrusive step disappears. Accordingly, the paper leaves 10 coming down along the back plate 13*a* smoothly drop to the bottom wall 11*a* without being caught by the upper surfaces of the back plates 13*b* and 13*c*, thus certainly putting the paper leaves 10 in order without disorder during the arrangement thereof. Moreover, even if the paper leaves 10 are returned while being turned clockwise in FIG. 7, since each of the upper surfaces of the back plates 13*b* and 13*c* is shifted backwardly with respect to the back plate 13*a* or 13*b* just above, it is possible to prevent the corners of the paper leaves 10 from being caught, which secures the certain arrangement of the paper leaves 10 without again disordering them during the arrangement.

On the other hand, on the bottom wall 11*a* side, there are provided a paper-leaves vibrating means 15 (see FIGS. 4, 5 and 19) for vibrating the paper leaves 10 placed on the depositing section 11 and for bringing two edges (lower side edges and back side edges) of the paper leaves 10 into contact with the bottom wall 11*a* and the back wall 11*b* for arranging the paper leans 10, a second paper-leaves conveying means 16 for horizontally sending the paper leaves 10 on the depositing section 11 to the paper-leaves feeding position 8 in a stand-up condition in cooperation with the paper-leaves conveying means 12, and others.

(Construction of Paper-Leaves Conveying Means)

Figure 8:
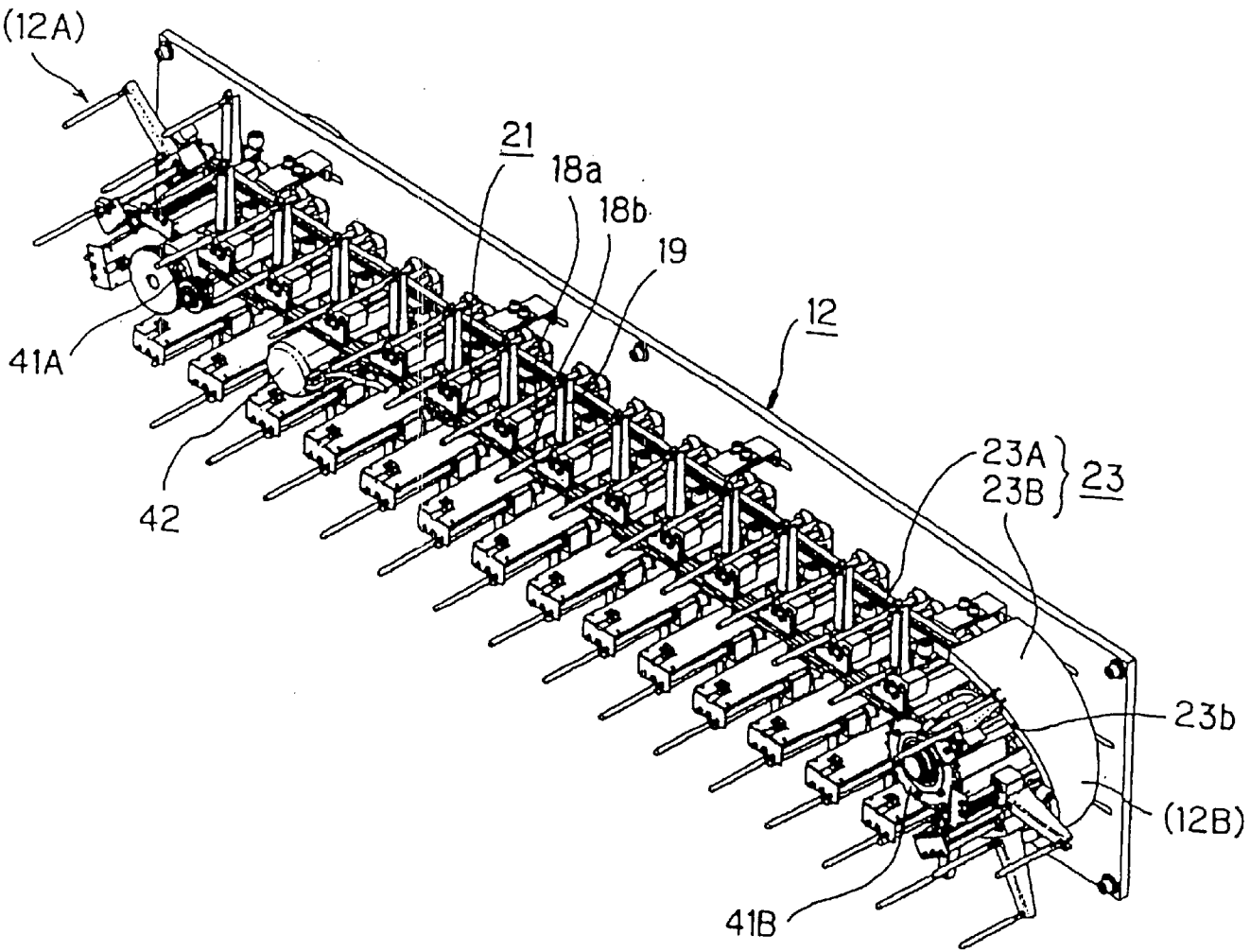
FIG. 8 is a perspective view entirely showing a paper-leaves conveying means according to the embodiment.
Figure 9:
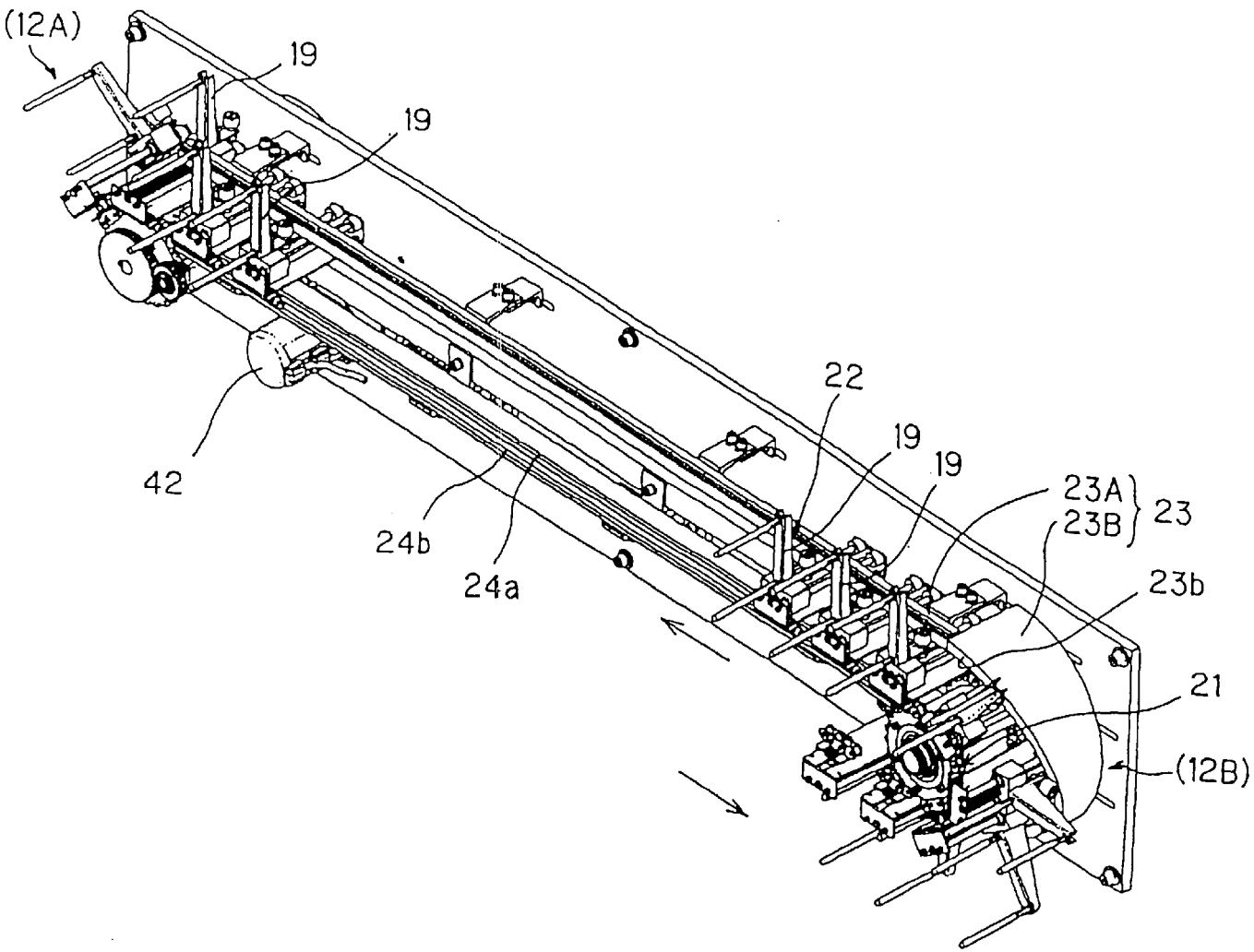
FIG. 9 is a perspective view showing an essential construction of the paper-leaves conveying means according to the embodiment.

As found from the entire construction of FIG. 8 and an essential construction of FIG. 9, the paper-leaves conveying means 12 is composed of an endless chain 21 constructed by successively joining, through chains 20, partitioning arm devices 19, each having two upper and lower arms 18*a* and 18*b* passing through the slits 14*a* and 14*b* of the back wall 11*b* and forwardly protruding at generally right angles from the back wall 11*b*, into an endless condition and disposing them at a substantially equal interval, a driving means 22 for placing this endless chain 21 in rotary motion, a cam device 23 for controlling the advancing/retracting operations of the partitioning arm devices 19 in placing the endless chain 21 in rotary motion, and other components. The driving means 22 includes a motor 42 as a drive source. In addition, the partitioning arm devices 19 are for subdividing the paper leaves 10, deposited together in a bundle in the depositing section 11, on the depositing section 11 and for supporting the subdivided paper leaves 10 from both the sides to hold them in a stand-up condition, and further conveying them to the paper-leaves feeding position 8 in this condition in cooperation with a second paper-leaves conveying means 16 which will be mentioned later. When positioned on the upper half side of the endless chain 21 by the rotary motion of the endless chain 21, the arms 18*a* and 18*b* of each of the partitioning arm devices 19 pass through the slits 14*a* and 14*b* and move toward the paper-leaves feeding position 8 in a state protruding forwardly at generally right angles from the back wall 11*b*, and when arriving at a position (end portion 12A) immediately before the paper-leaves feeding position 8, retract backwardly from the back wall 11*b*. Thereafter, they are positioned on the lower half side of the endless chain 21 turned downwardly to move toward an end portion 12B opposite to the paper-leaves feeding position 8, and are again turned upwardly from the end portion 12B. Still additionally, immediately before the end portion 12B, the arms 18*a* and 18*b* of the partitioning arm device 19 are guided by the cam device 23 to again pass through the slits 14*a* and 14*b* for protruding forwardly from the back wall 11*b*, and then are guided to move toward the paper-leaves feeding position 8 by the upper half side of the endless chain 21.

(Structure of Cam Device)

Figure 10:
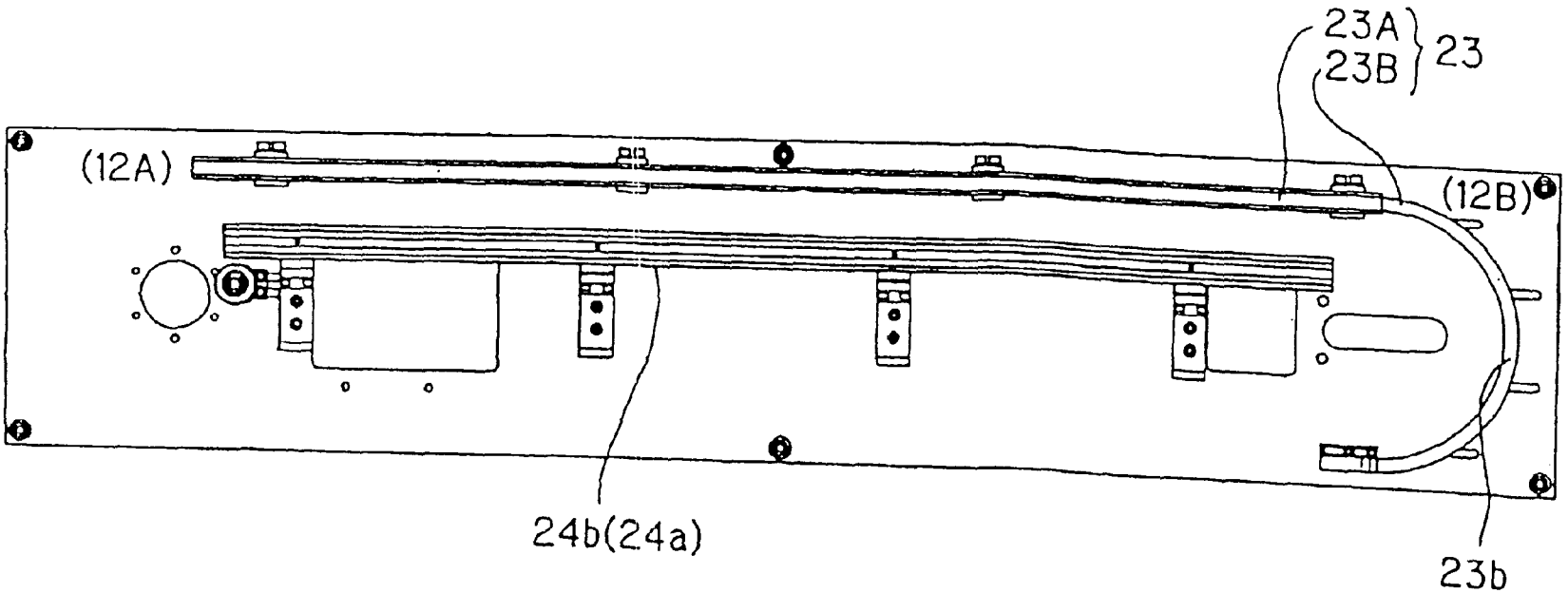
FIG. 10 is a front elevational view showing the essential construction of the paper-leaves conveying means according to the embodiment.
Figure 11:
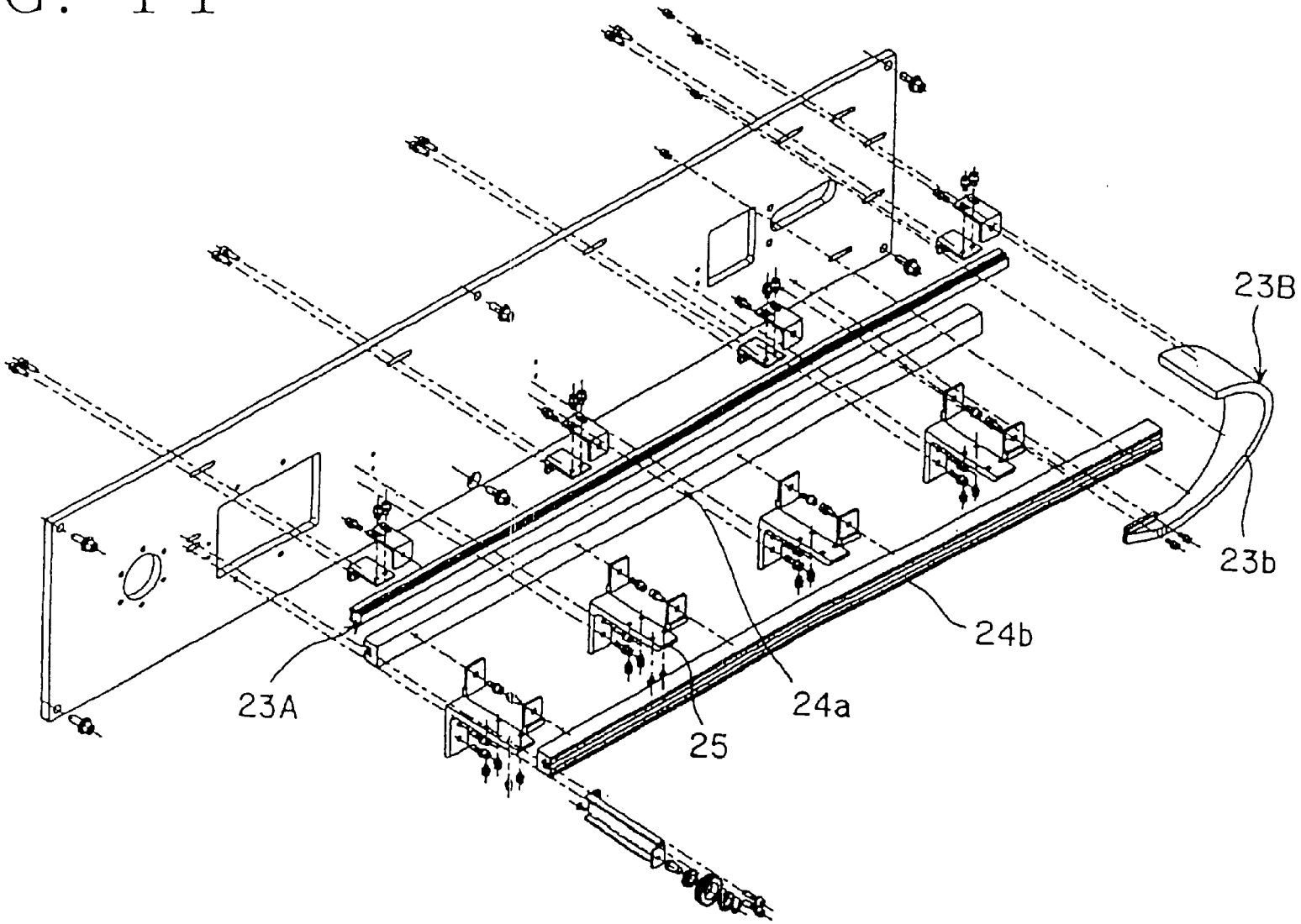
FIG. 11 is an exploded perspective view showing the essential construction of the paper-leaves conveying means according to the embodiment.
Figure 12:
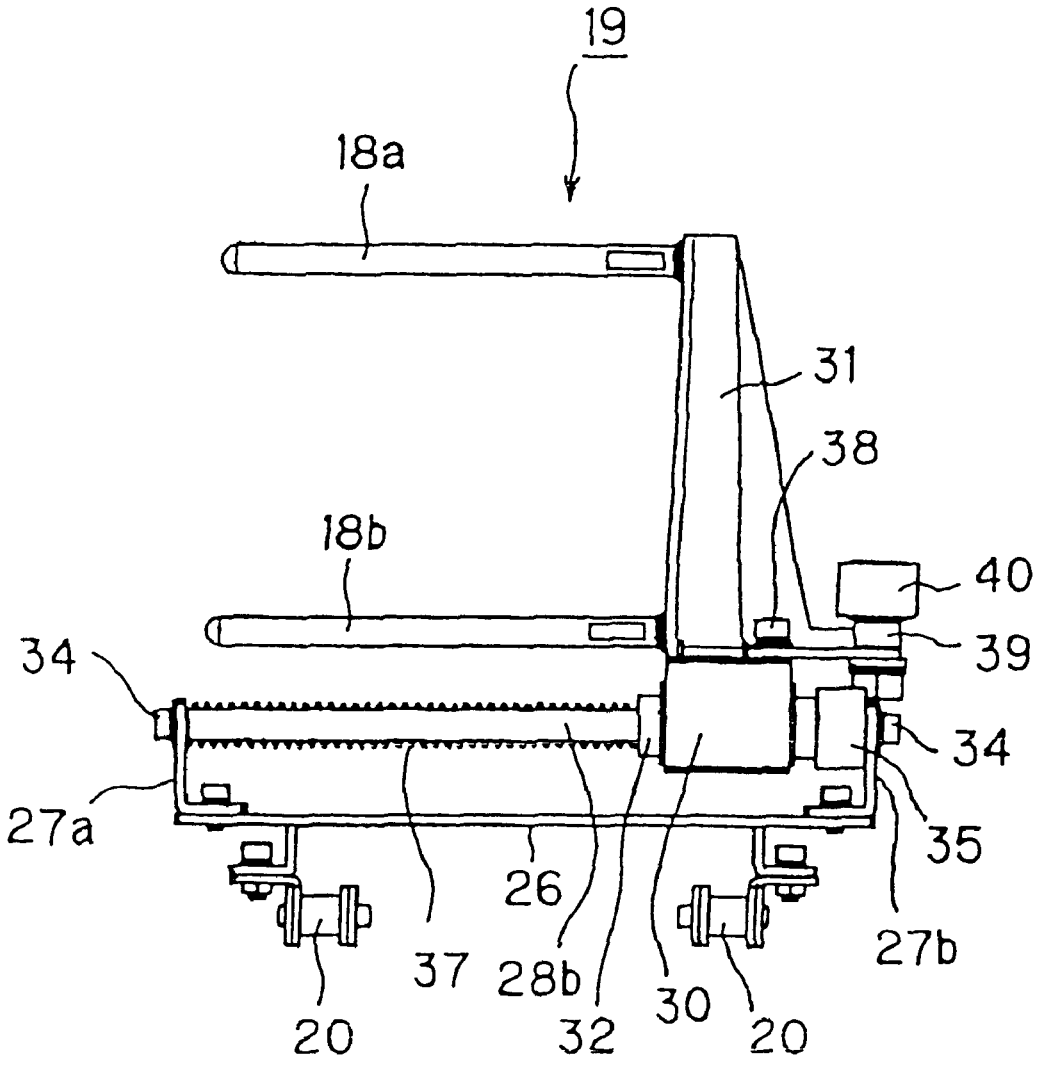
FIG. 12 is a side elevational view showing a partitioning arm device of the paper-leaves conveying means according to the embodiment.
Figure 13:
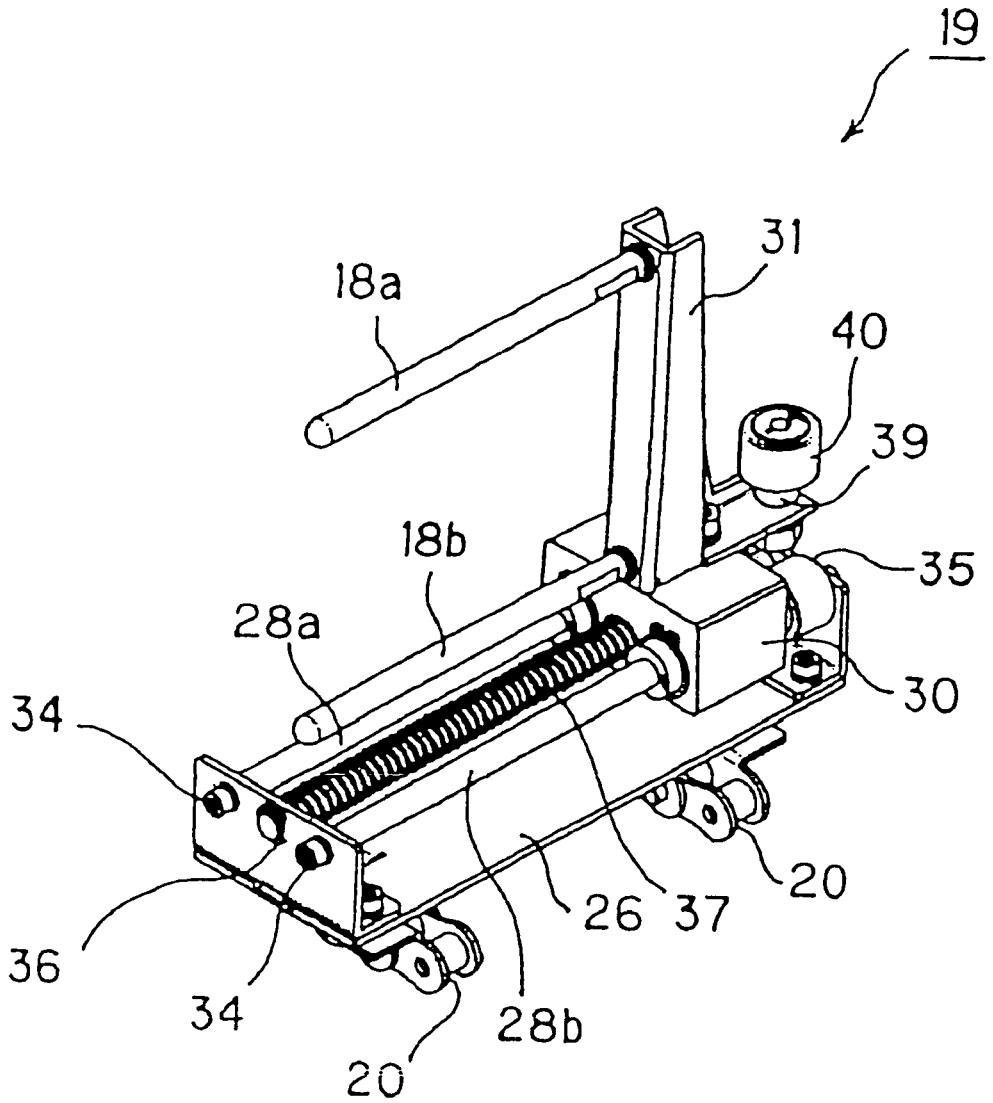
FIG. 13 is a perspective view showing the partitioning arm device of the paper-leaves conveying means according to the embodiment.
Figure 14:
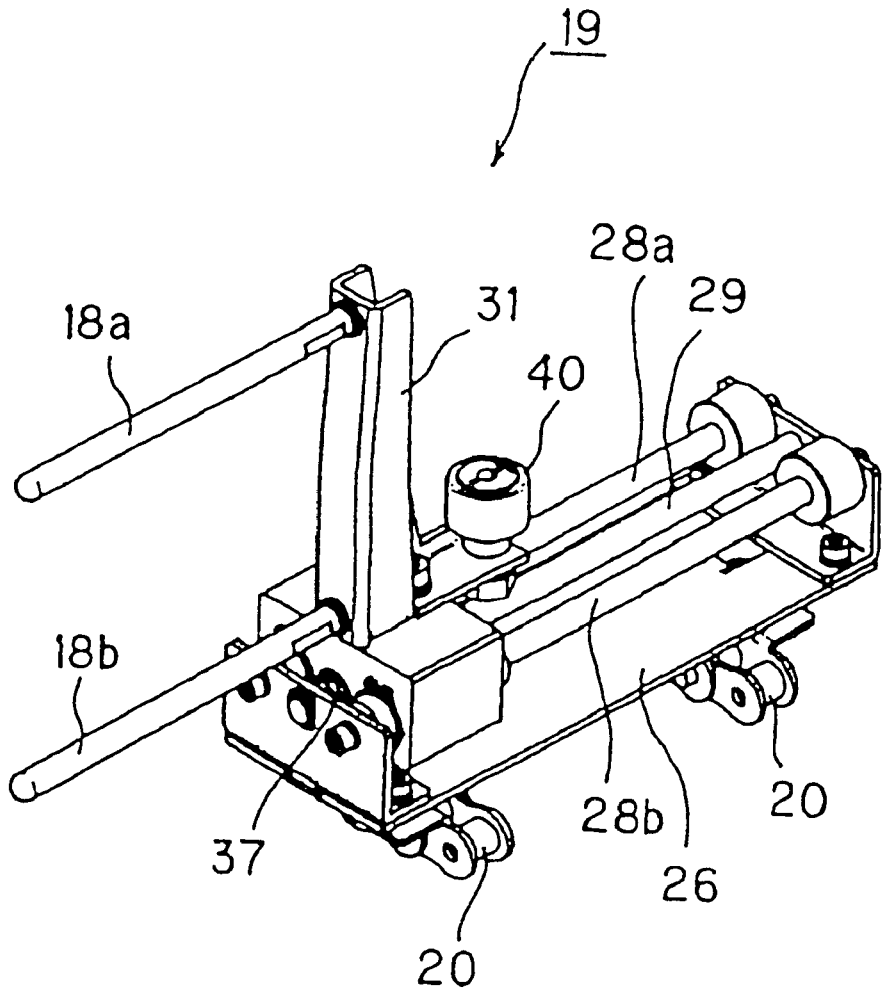
FIG. 14 is a perspective view showing the partitioning arm device of the paper-leaves conveying means according to the embodiment.
Figure 15:
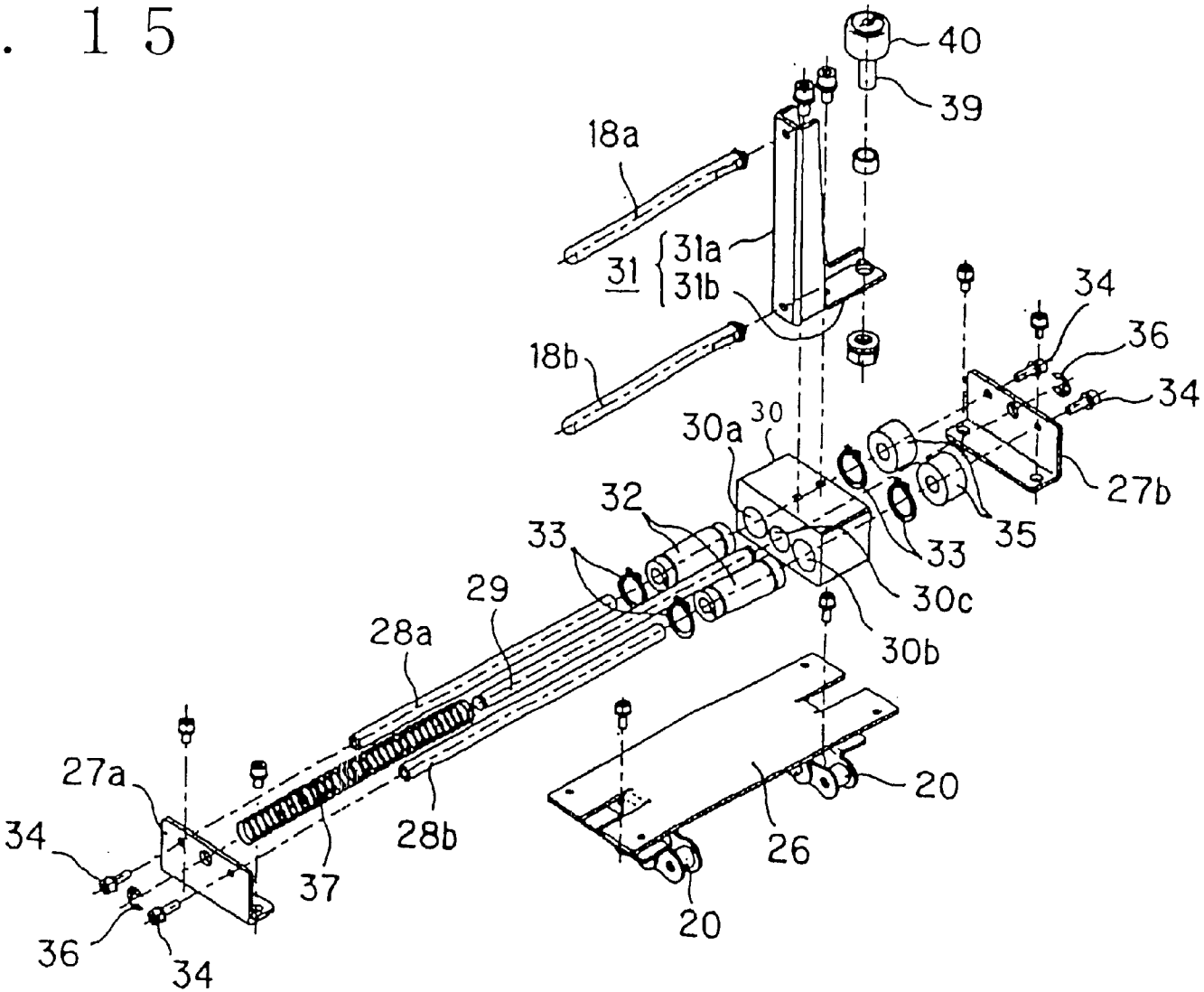
FIG. 15 is an exploded perspective view showing the partitioning arm device of the paper-leaves conveying means according to the embodiment.

As shown in detail in FIGS. 9 to 11, the cam device 23 is composed of a first cam 23A disposed along the traveling path of the partitioning arm devices 19 guided on the upper half side of the endless chain 21, and a second cam 23B disposed along the traveling path of the partitioning arm device 19 at the end portion 12B of the traveling chain 21 opposite to the paper-leaves feeding position 8. The second cam 23B has a generally U-like configuration and an inclined surface 23*b* tilted so that it gradually protrudes forwardly as the turning to the upper side proceeds, and the inclined surface 23*b* is made to shows the maximum protrusion quantity at the time of the completion of the turning to the upper side. On the other hand, the first cam 23A is made in the form of one rail member having a column-like configuration, and is disposed in a state continuously joined to an end portion (the maximum protruding portion of the inclined surface 23*b*) of the second cam 23B and extends straight toward the paper-leaves feeding position 8 (end position 12A) in a state where the maximum protrusion quantity is maintained. On the paper-leaves feeding position 8 side, the first cam 23A is positioned so that a roller 40 of the partitioning arm device 19 is brought into contact therewith until the arms 18*a* and 18*b* of the partitioning arm device 19 moved to the nearest position to the paper-leaves feeding position 8, accommodating about one paper leaves 10 therebetween, come to a position immediately before coming into contact with a belt contact surface 67*a* of a separating/supplying belt 67 of the paper-leaves separating/supplying apparatus 9 (see FIG. 12). In the vicinity of the location of the first cam 23A, a pair of guide bars 24*a* and 24*b* are placed along the first cam 23A in front and in rear (see FIGS. 10 and 11). The pair of guide bars 24*a* and 24*b* are held in parallel with each other through a spacer 25 fixed on the apparatus body side to support, from the under, the upper half of the endless chain 21 traveling toward the paper-leaves feeding position 8 in a state brought into contact with the first cam 23A after the completion of the turning from the lower side.

(Construction of Partitioning Arm Device)

As shown in detail in FIGS. 12 to 17, the partitioning arm device 19 is composed of a fitting plate 26 fixedly secured to extend between a pair of chains 20 in front and in rear, a pair of guide bars 28*a*, 28*b* and center bar 29 whose both front and rear end portions are fixed to brackets 27*a* and 27*b* fixed to both front and rear end portions of the fitting plate 26, a slider 30 attached to the guide bars 28*a*, 28*b* and the center bar 29 to be slidable forwardly and backwardly, an arm holder 31 fixedly secured onto the slider 30, the aforesaid pair of arms 18*a* and 18*b* fixedly secured onto the arm holder 31, and other components. The slider 30, as shown in the exploded perspective view of FIG. 15, has through holes 30*a* and 30*b* made at right and left positions to pass therethrough and further has a through-hole 30*c* made at a central position to similarly pass therethrough. A cylindrical slide bush 32 is inserted into each of the through holes 30*a* and 30*b*, and the slide bush 32 is fixed to the slider 30 through snap rings 33 mounted over the slide bush 32 before and after the slider 30. In addition, the guide bars 28*a* and 28*b* penetrate the slider 30 after passing through the slide bushes 32, and both end portions thereof are fixedly secured to the brackets 27*a* and 27*b* by means of vises 34 so that the slider 30 is slidable forwardly and backwardly. In this case, when the slider 30 are fitted over the guide bars 28*a* and 28*b*, a ring-like spacer 35 is placed between the slider 30 and the bracket 27*b* in order to limit the sliding amount of the slider 30. The center bar 29 penetrates the through hole 30*c* of the slider 30 and is disposed to be in parallel with the guide bars 28*a* and 28*b*, and both the end portions thereof penetrate the brackets 27*a* and 27*b*, respectively, and are fixedly positioned by E rings 36 in the exterior of the brackets 27*a* and 27*b*. Moreover, a coil spring 37 is set on the center bar 29 between the bracket 27*a* and the slider 30 in a state compressed to press the slider 39 against the bracket 27*b* side at all times (see FIGS. 12 and 13). The arm holder 31 has a generally L-shaped configuration, and a vertical portion 31*a* is turned forwardly and a horizontal portion 31*b* bent backwardly from the lower end side of the vertical portion 31*a* at substantially right angles is fixedly secured onto the upper surface of the slider 30 by means of vises 38. The pair of arms 18*a* and 18*b* separated vertically are fitted to the vertical portion 31*a* in a state protruded forwardly at substantially right angles. On the other hand, the roller 40 is fitted to the rear end side of the horizontal portion 31*b* to be rotatable horizontally around a rotary shaft 39 extending upwardly at right angles from the horizontal portion 31*b*. This roller 40 is in conjunction with the first cam 23A and the second cam 23B, and is capable of coming into contact with the first cam 23A and the second cam 23B.

The driving means 22 is equipped with rotary drums 41A and 41B rotatably disposed separately at right and left end portions of the depositing section 11 (see FIGS. 16 and 17), with toothed wheels (not shown) to be engaged with the chains 20 being formed on the outer circumferences of the rotary drums 41A and 41B as a unit. In addition, on the rotation of the rotary drums 41A and 41B, the toothed wheels are successively engaged with the chains 20 so that the endless chain 21, together with the partitioning arm devices 19, travels endlessly in the rotating direction of the rotary drums 41A and 41B. Of the rotary drums 41A and 41B, the rotary drum 41A acts as a driving drum while the rotary drum 41B acts as an idler drum, and the rotary drum 41A is made to rotate in response to a rotational driving force from a motor 42. That is, the rotation of the motor 42 causes the rotation of the rotary drum 41A, and makes the slave rotation of the rotary drum 41B according to the rotation of the rotary drum 41A through the chains 20, thus accomplishing the endless rotation of the endless chain 21.

Figure 16:
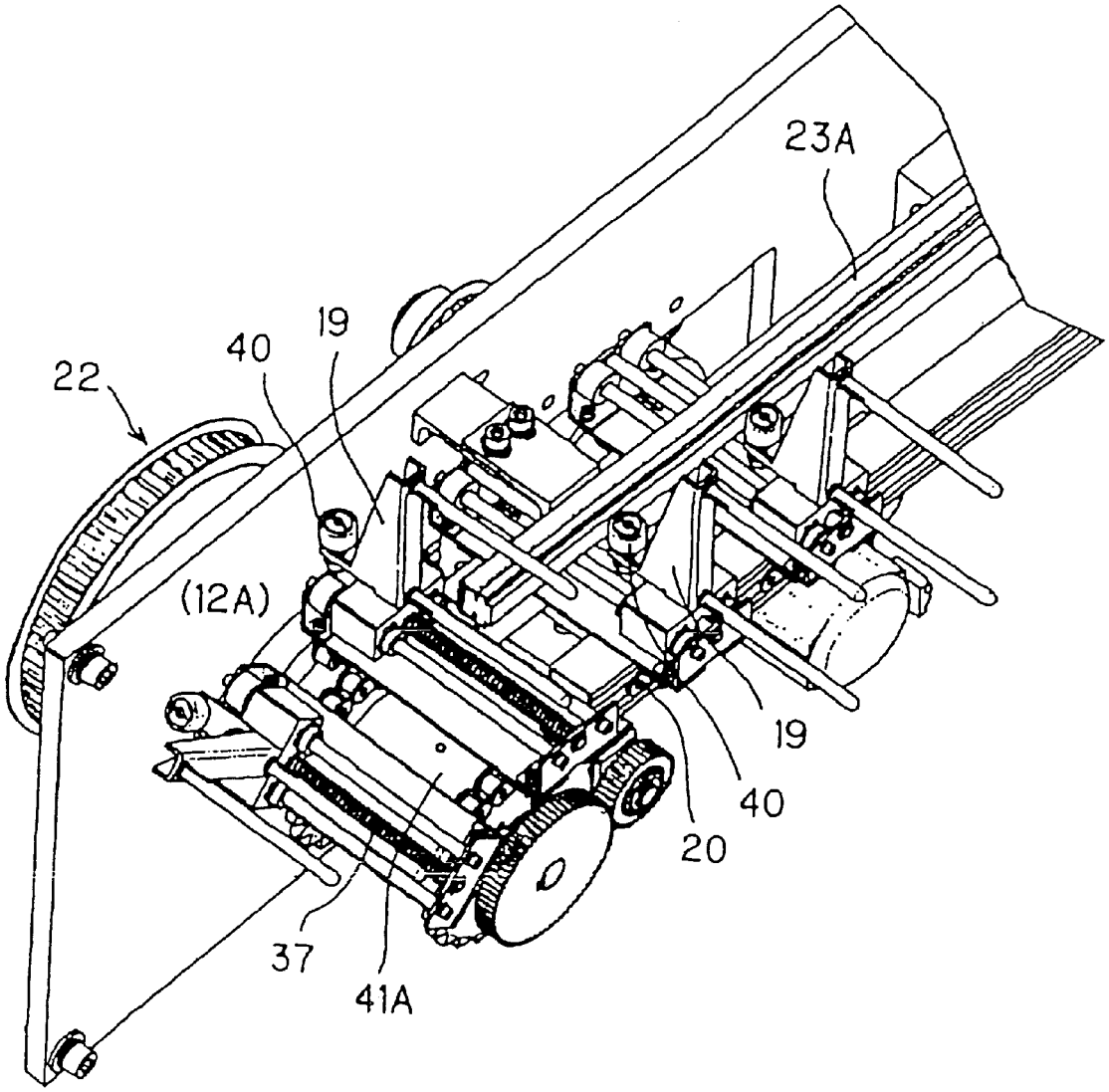
FIG. 16 is an illustration of an operation of the partitioning arm device according to the embodiment.

Secondly, a description will be given of an operation of the partitioning arm device 19 in the construction of the aforesaid paper-leaves conveying means 12. When the partitioning arm device 19 confronts the first cam 23A, the roller 40 is brought into contact with the first cam 23A, and the slider 30 is pressed toward the bracket 27*a* against the repulsion of the coil spring 37 as shown in portions of FIGS. 14 and 16 so that the arms 18*a* and 18*b* protrude forwardly a great deal from the back wall 11B. In addition, the arms 18*a* and 18*b* are shifted from the end 12B side to the end 12A side (paper-leaves feeding position 8) in the slits 14*a* and 14*b* in accordance with the rotary motion of the endless chain 21 in the protruding condition. At this time, a plurality of paper leaves 10, deposited together in a bundle in a stand-up condition in the depositing section 11 in a state subdivided between the partitioning arm devices 19 and 19 and supported by the arms 18*a*, 18*b* and the arms 18*a*, 18*b* from both the sides, are shifted toward the paper-leaves feeding position 8 by being pressed by the arms 18*a* and 18*b*, coupled with the conveyance due to the second paper-leaves conveying means 16 and the vibration due to the paper-leaves vibrating means 15 which will be described hereinafter. Still additionally, when the partitioning arm device 19 is shifted to the paper-leaves feeding position 8 and the roller 40 is separated from the first cam 23A, the slider 30 is instantaneously moved to the bracket 27*b* side by the repulsion of the coil spring 37 in a state guided by the guide bars 28*a* and 28*b* as shown partially in FIGS. 12, 13 and 16. That is, with this movement, the tip portions of the arms 18*a* and 18*b* retreat to a position behind the back wall 11*b*. FIG. 16 illustrates a peripheral structure around the paper-leaves feeding position 8, and shows a state in which that arms 18*a* and 18*b* of the partitioning arm device 19, which are not separated from the first cam 23A, protrude forwardly and the arms 18*a* and 18*b* of the partitioning arm device 19, separated from the first cam 23A, retreat up to the position behind the back wall 11*b*.

Figure 17:
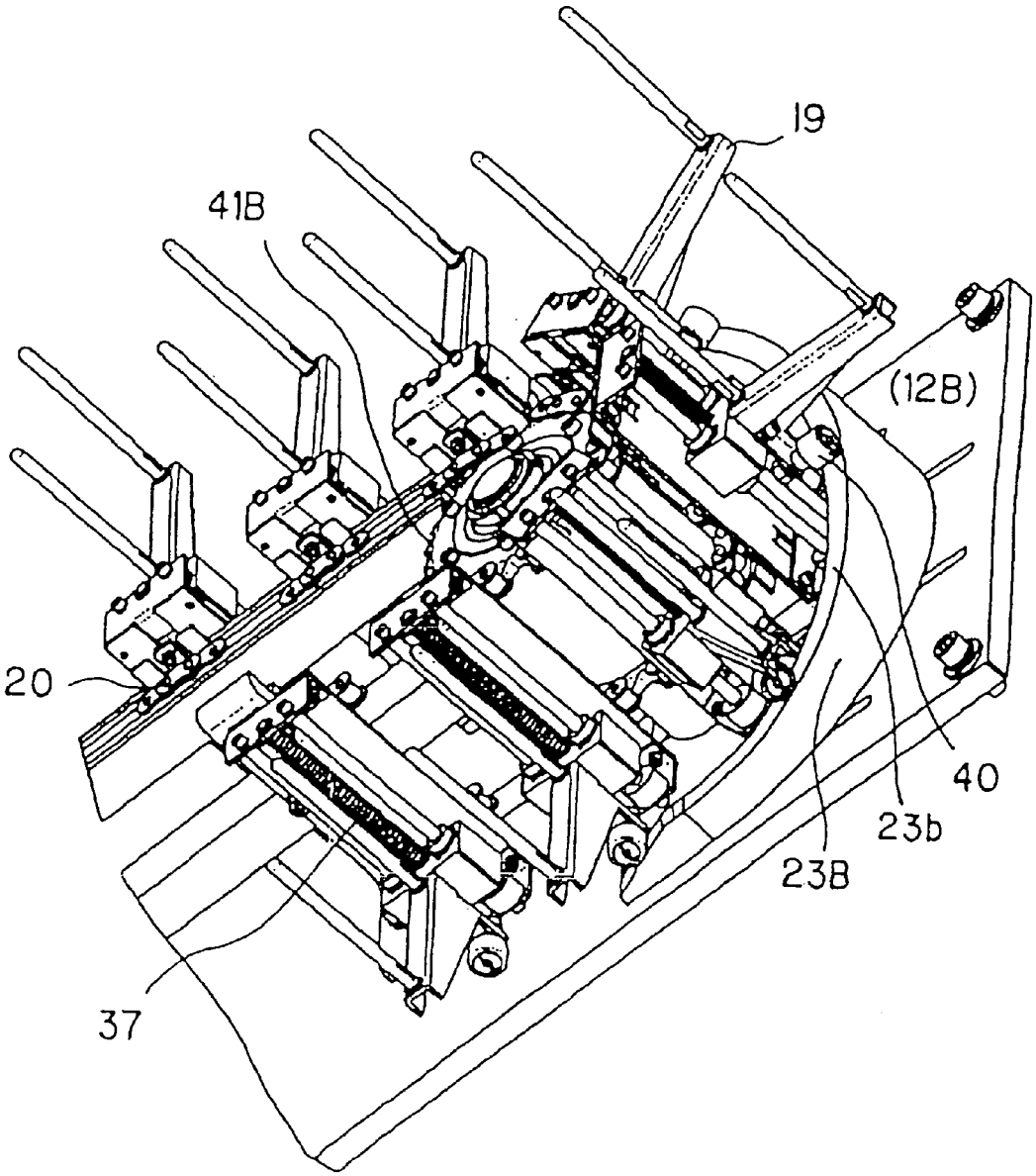
FIG. 17 is an illustration of an operation of the partitioning arm device according to the embodiment.

Furthermore, at the paper-leaves feeding position 8, the partitioning arm device 19 whose arms 18*a* and 18*b* retreat up to the position behind the back wall 11*b* is shifted up to the other end portion 12*b* through the endless chain 21 in the arms 18*a* and 18*b* retreated state, and the roller 40 is brought into contact with a minimum height portion of an inclined surface 23*b* of the second cam 23B immediately before the other end portion 12B. Moreover, when the roller 40 is moved together with the endless chain 21 in a state brought into contact with the inclined surface 23*b*, the height of that inclined surface 23*b* becomes gradually higher and the cam action of the inclined surface 23*b* causes the slider 30 to be gradually shifted to the bracket 27*a* side while compressing the coil spring 37 so that the arms 18*a* and 18*b* again protrude forwardly a great deal with respect to the back wall 11*b*. FIG. 17 is an illustration of a state in which the arms 18*a* and 18*b* protrude with the roller 40 being brought into contact with the inclined surface 23*b* of the second cam 23*b* at the other end portion 12B. This protrusion reaches a maximum at a portion adjacent to the first cam 23A, and when the roller 40 arrives at an end of the second cam 23B, they are shifted to the first cam 23A and conveyed toward the paper-leaves feeding position 8 while being again brought into contact with the first cam 23A. Immediately before shifting from the second cam 23B to the first cam 23A, the arms 18*a* and 18*b* again confront the slits 14*a* and 14*b*, and then pass through the slits 14*a* and 14*b* and reach the paper-leaves feeding position 8.

Accordingly, in the construction according to this embodiment, when the roller 40 is moved in a state brought into contact with the first cam 23A, the arms 18*a* and 18*b* are shifted toward the paper-leaves feeding position 8 in a state where they protrude from the back wall 11*b*, and when the partitioning arm device 19 approaches the paper-leaves feeding position 8 and the roller 40 separates from the first cam 23A, the arms 18*a* and 18*b*, together with the slider 30, retreat to the position behind the back wall 11*b*. In addition, the arms 18*a* and 18*b* are moved toward the other end portion 12B in the retreated state, and when they approach the other end portion 12B, the roller 40 comes into contact with the second cam 23B. When they are shifted continuously, the same cycle takes place repeatedly, that is, the slider 30, together with the arms 18*a* and 18*b*, is again carried to above the first cam 23 while protruding forwardly. With this operation, the paper leaves 10 placed on the depositing section 11 are successively shifted toward the paper-leaves feeding position 8.

In this construction according to this embodiment, the position of the end portion of the first cam 23A on the paper-leaves feeding position 8 side is set such that the arms 18*a* and 18*b* support the paper leaves 10 until reaching a position immediately before a position at which the last paper leaves 10 being carried toward the paper-leaves feeding position 8 can lightly touch the separating/supplying belt 67 of the paper-leaves separating/supplying apparatus 9, which will be described later, at the paper-leaves feeding position 8. Concretely, as mentioned above, the arms 18*a* and 18*b* are designed to retreat instantaneously when the paper leaves 10 lightly touch the paper-leaves separating/supplying apparatus 9. With this structure, the last paper leaf is conveyed until lightly touching the belt contact surface 67*a* of the separating/supplying belt 67 of the paper-leaves separating/supplying apparatus 9 at the paper-leaves feeding position 8, thus securing the certain delivery. On the other hand, the paper-leaves conveying means of the conventional apparatus cannot achieve the retreat of the arms immediately before the paper-leaves feeding position. In addition, since the mechanism is made to select the retreating operation, the traveling speed of the retreating arms to the paper-leaves feeding position increases or decreases with respect to the arms traveling behind to lengthen or shorten the arm interval, which can cause the overlap transportation of the paper leaves. Still additionally, the arms themselves cannot retreat instantaneously, but the arms gradually and slowly retreat before arriving at the paper-leaves feeding position. That is, since the arms of the paper-leaves conveying means of the conventional apparatus is not designed to reach a position immediately before the paper-leaves feeding position in a state where they protrude, the operator is required to directly support the paper leaves in order to bring the paper leaves, which tend to fall down rearwardly, into contact with a separating/feeding surface (belt contact surface), and this creates a problem on safety and a problem in that difficulty is encountered in performing the work by one person. The construction according to this embodiment, by contrast, is made such that the arms 18*a* and 18*b* protrude until reaching a position immediately a position at which the last paper leaf 10 comes into contact with the belt contact surface 67*a* of the paper-leaves separating/supplying apparatus 9; therefore, it is possible to eliminate the transfer failures that the paper leaves 10 fall down rearwardly before coming into contact with the belt contact surface 67*a*. This can eliminate the need for the stationing of full-time operators who are required to solve the rearwardly falling-down problem, which has been required in the case of the conventional apparatus, and hence, it is possible to reduce the staff and further to slice the cost. In addition, with the construction according to this embodiment, the position of the first cam 23A on the paper-leaves feeding position 8 side, that is, the position at which the roller 40 of the partitioning arm device 19 is separated from the first cam 23A to allow the arms 18*a* and 18*b* to retreat, is arbitrarily adjustable.

(Construction of Second Paper-Leaves Conveying Means)

Figure 18:
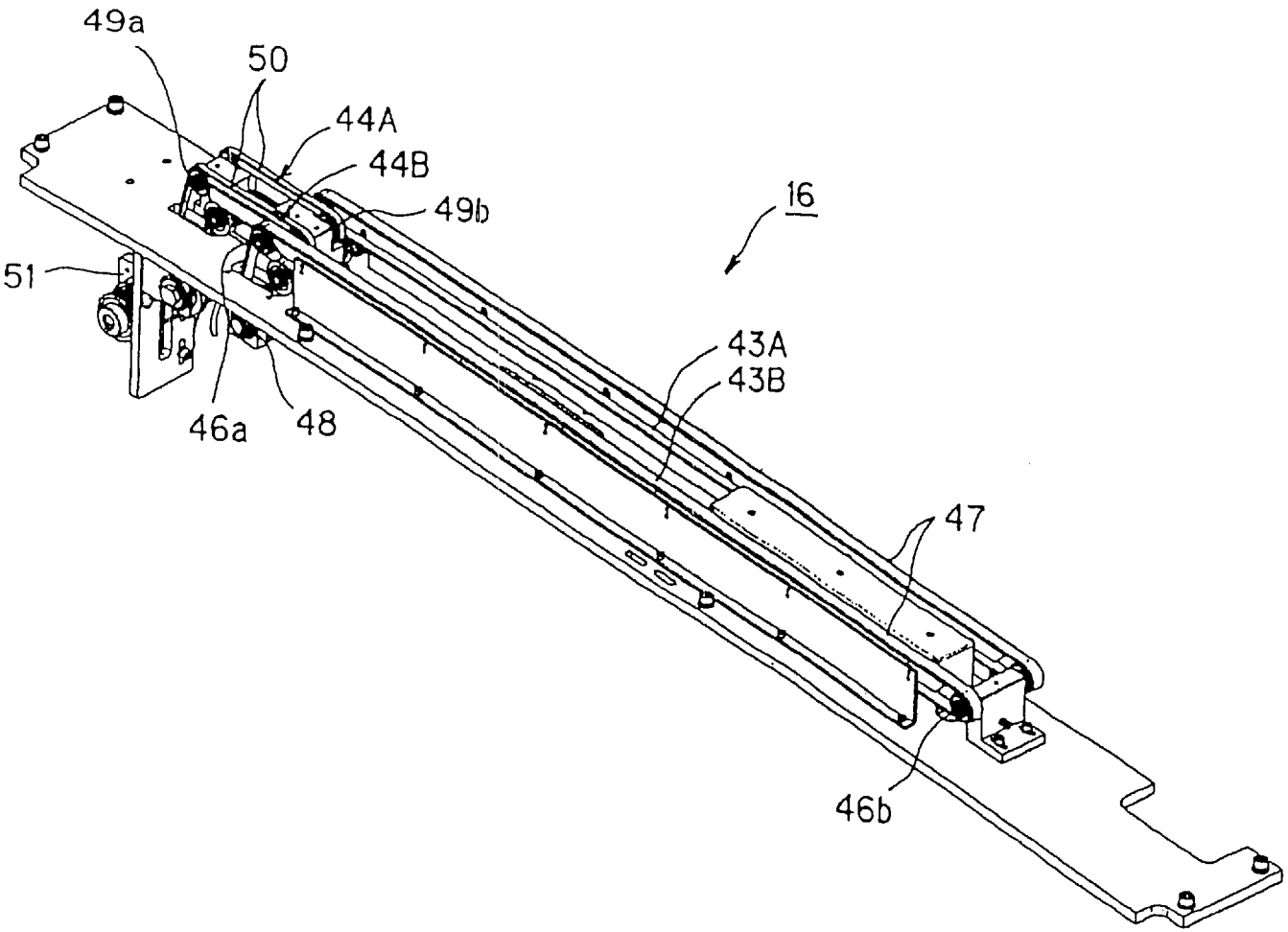
FIG. 18 is a perspective view showing an essential construction of a depositing section according to the embodiment.

As shown in the detailed construction of FIG. 18, the second paper-leaves conveying means 16 is composed of a pair of conveying belt means 43A and 43B extending in right and left directions in parallel with the endless chain 21 on the back wall 11*b* side, and a pair of auxiliary conveying belt means 44A and 44B extending in right and left directions between the pair of conveying belt means 43A, 43B and the paper-leaves feeding position 8 in a state partially overlapping with the conveying belt means 43A, 43B. The pair of auxiliary conveying belt means 44A and 44B are placed between the conveying belt means 43A and 43B.

The conveying belt means 43A and 43B are composed of a driving pulley 46*a*, an idler pulley 46*b* and two endless belts 47 stretched between the driving pulley 46*a* and the idler pulley 46*b*. A surface of the endless belt 47 has a teeth-like configuration, and protrudes upwardly from an opening 11*c* (see FIG. 6) of the bottom wall 11*a* of the depositing section 11. Moreover, the surfaces of the endless belts 47 directly receive the paper leaves 10 put on the depositing section 11, and the rotary motion of the endless belts 47 sends the paper leaves 10 toward the paper-leaves feeding position 8. At this time, the driving pulley 46*a* rotates by receiving a driving force of the motor 42, which drives the paper-leaves conveying means 12, through a power conveying belt (not shown), and hence, the second paper-leaves conveying means 16 is operated at a speed synchronized fully with the paper-leaves conveying means 12. In addition, the endless belts 47 and the idler pulley 46*b* are also driven rotationally in accordance with the rotation of the driving pulley 46*a*.

The auxiliary conveying belt means 44A and 44B are composed of a driving pulley 49*a*, an idler pulley 49*b* and endless belts 50 extending between the driving pulley 49*a* and the idler pulley 49*b*. The surface of each of the endless belts 50 is made smooth unlike that of the endless belts 47 of the conveying belt means 43A and 43B in order to lessen the frictional force with respect to the paper leaves 10. In addition, the endless belt 50 is disposed so that its upper surface protrudes upwardly from an opening lid (see FIG. 6) of the bottom wall 11*a* of the depositing section 11, and the endless belts 50 directly receive the paper leaves 10 put on the depositing section 11, and the rotary motion of the endless belts 50 transfers the paper leaves 10 toward the paper-leaves feeding position 8. In this case, the endless belts 50 can also be revolved in a direction opposite to the normally feeding direction, that is, in a direction separating from the paper-leaves feeding position 8. The traveling speed of the endless belts 50 is the same as that of the paper-leaves conveying means 12 when the paper leaves 10 move toward the paper-leaves feeding position 8, while it is set to be higher, irrespective of the speed of the paper-leaves feeding means 12, when the paper leaves 10 separate from the paper-leaves feeding position 8.

The first reason for rotating the auxiliary conveying belt means 44A and 44B in the forward and reverse directions is because, when the paper leaves 10 are conveyed successively to become an excessively pressed condition in the area of the paper-leaves feeding position 8, the conveyance by the paper-leaves conveying means 12 and the conveying belt means 43A and 43B is ceased and the endless belts 50 are put in rotary motion in the reverse direction immediately before separation for once returning the paper leaves 10 to relieve the excessively pressed condition of the paper leaves 10 at the paper-leaves feeding position 8 so that the paper leaves are certainly suction-attached one by one onto the separating/supplying belt 67 to be easily fed to the downstream side. The second reason is because, in a state where the paper leaves 10 deposited in the depositing section 11 in a state tilted rearwardly does not reach a position at which the paper leaves 10 are sufficiently attracted by the belt contact surface 67*a*, a contact 92 connected to a paper-leaves arrival detecting means 106 is pressed so that an arrival sensor 93 makes a decision that the detected paper leaf 10 arrives at the paper-leaves feeding position 8, and, although the higher-speed feeding operation is to be still conducted, the feeding speed is reduced to a speed synchronized with the feeding operation of the separating/supplying device 63 to cause the wasteful time which makes it difficult to promptly feed the paper leaves 10, so the paper leaves 10 conveyed up to the paper-leaves feeding position 8 in a rearwardly inclined posture is shifted to the forwardly inclined condition for shortening this wasteful time. In addition, the surface of the endless belt 50 is made smooth to reduce the frictional force with respect to the paper leaves. This is because, in a case in which the paper leaves 10 fall into an excessively pressed condition at the paper-leaves feeding position 8 or the paper leaves 10 deposited in the depositing section 11 in a rearwardly inclined posture are conveyed up to the paper-leaves feeding position 8 in this posture, there is a need to reverse only the endless belts 50 in a state where stopped are the paper-leaves conveying means 12 and the second paper-leaves conveying means 16. That is, if the belt surface shows a large frictional force or has a teeth-like configuration, when the endless belts 50 are reversed at a high speed in a state where stopped are the paper-leaves conveying means 12 and the second paper-leaves conveying means 16, the paper leaf 10 retreating from the paper-leaves feeding position 8 is interposed between the paper-leaves conveying means 12, the second paper-leaves conveying means 16 and the endless belts 50 so that only the lower surface of the paper leaf 10 has nowhere to go, which naturally causes the paper leaf 10 to be separated from the belt surface. Although this separation can damage the lower surface of the paper leaf 10, since the belt surface is made smooth to reduce the friction, it is possible to eliminate the possibility of such damages of the paper leaves.

(Structure of Paper-Leaves Vibrating Means)

Figure 19:
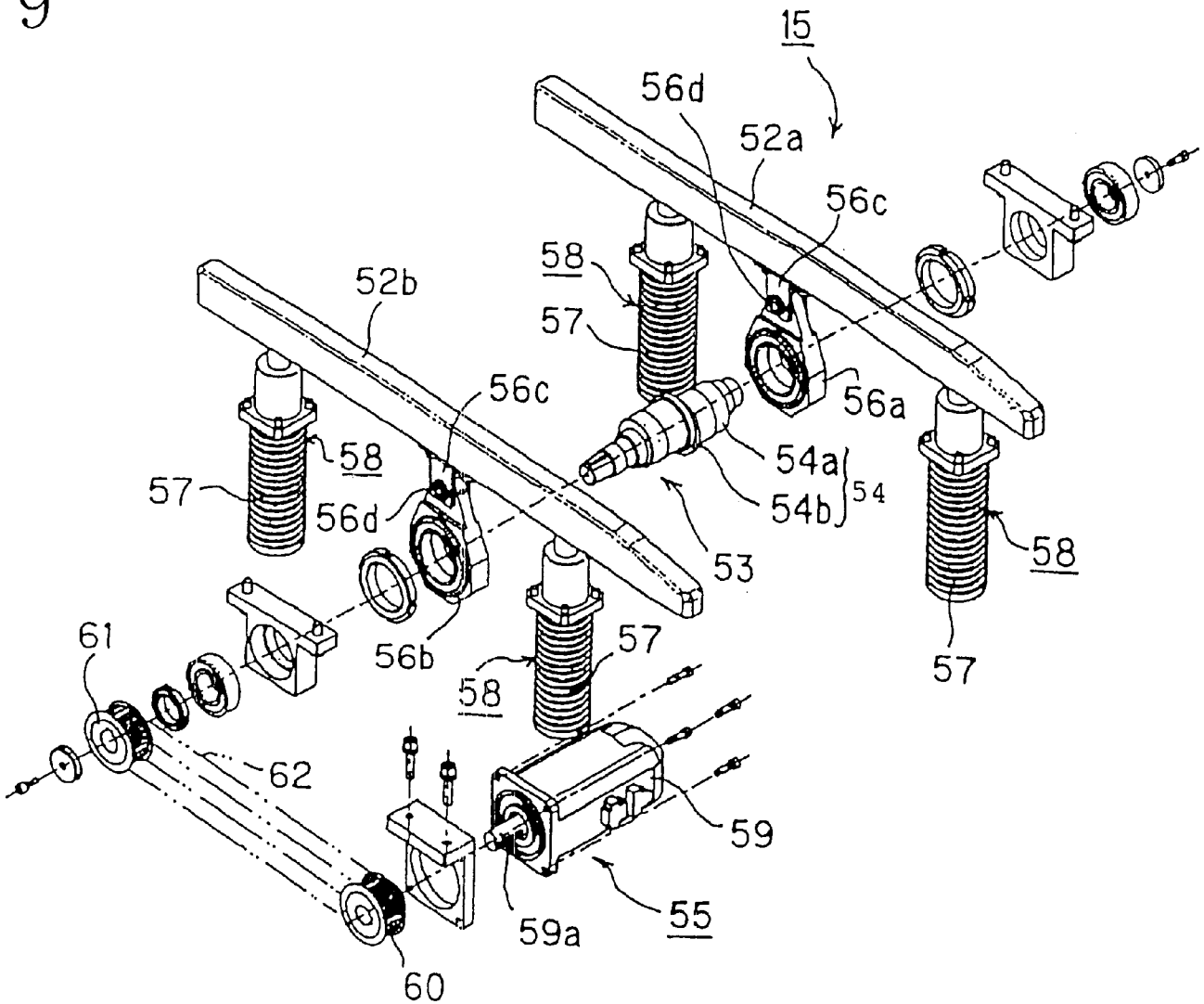
FIG. 19 is an exploded perspective view showing a paper-leaves vibrating device according to the embodiment.

The paper-leaves vibrating means 15 is, as shown in detail in FIG. 19, composed of elongated vertically-movable members 52*a* and 52*b* extending in right and left directions in parallel with the endless belts 47 between the conveying belt means 43A and 43B, a vibration generating means 53 for alternately and vertically moving the vertically-movable members 52*a* and 52*b*, and others. Each of the vertically-movable members 52*a* and 52*b* is made to protrude a great deal from the bottom wall 11*a* through an opening 11*e* (see FIG. 6) made in the bottom wall 11*a* and to retreat therefrom.

The vibration generating means 53 includes a rotary shaft 54 which integrally has eccentric cams 54*a* and 54*b* on its circumferential surface, a driving means 55 for rotating this rotary shaft 54, cam rings 56*a* and 56*b* acting as a link member for transmitting the cam actions of the eccentric cams 54*a* and 54*b* to the vertically-movable members 52*a* and 52*b*, and others. The cam ring 56*a* is rotatably fitted to the eccentric cam 54*a*, while the cam ring 56*b* is rotatably fitted to the eccentric cam 54*b*. In this embodiment, the eccentric cams 54*a* and 54*b* are disposed in a state shifted by 180 degrees from each other in the rotating direction. In addition, the cam rings 56*a* and 56*b* are connected through brackets 56*c* and rotary shafts 56*d* to the central portions of the vertically-movable members 52*a* and 52*b*, respectively. When the rotary shaft 54 is put in rotation so that the eccentric cams 54*a* and 54*b* vertically move the cam rings 56*a* and 56*b*, the vertically-movable members 52*a* and 52*b* are moved vertically in connection with the cam rings 56*a* and 56*b*. In addition, on both the right and left sides of each of the vertically-movable members 52*a* and 52*b*, pulling means 58 are provided each of which has a coil spring 57 for pulling the vertically-movable member 52 or 52*b* downwardly at all times.

The driving means 55 includes a motor 59, a pulley 60 attached to an output shaft 59*a* of the motor 59 to be rotatable together, a pulley 61 fitted to the rotary shaft 54 to be rotatable together, and a power transmitting belt 62 set to extend between the pulley 60 and the pulley 61. The rotation of the motor 59 is transferred to the output shaft 59*a*, the pulley 60, the power transmitting belt 62 and the pulley 61 so that the rotary shaft 54 is rotatable together with the pulley 61.

In the paper-leaves vibrating means 15 thus constructed, on the rotation of the rotary shaft 54 by the motor 59, the vertically-movable members 52*a* and 52*b* are alternately moved vertically such that the eccentric cams 54*a* and 54*b* pushes up one of the vertically-movable members 52*a* and 52*b* through the cam rings 56*a* and 56*b* and pull down the other. That is, one vertically-movable members 52*a* (or 52*b*) passes through the opening 11*e* to protrude from the bottom wall 11*a*, while the other vertically-movable member 52*b* (or 52*a*) retreats downwardly with respect to the bottom wall 11*a*. In addition, the entire depositing section 11 is in a state inclined backwardly by approximately 15 degrees, and the self-weight of the paper leaf 10 is divided in the back surface direction and in the bottom surface direction, and when the paper leaf 10 is pushed up from the under by the vertically-movable member 52*a* or 52*b*, the paper leaf 10 is vibrated in a state turned around the corner forming the intersection of the bottom surface and back surface thereof. Still additionally, since the two vertically-movable members 52*a* and 52*b* are disposed in a state separated from each other, they hit against the paper leaf 10 at different positions, and different amplitudes take place for when the front side vertically-movable member 52*b* protrudes to vibrate the paper leaf 10 and for when the rear side vertically-movable member 52*a* protrudes to vibrate the paper leaf 10, and at the same time, slight rotating force is given thereto, thus achieving proper arrangement (alignment) with high efficiency in a short time.

(Construction of Paper-Leaves Separating/Supplying Apparatus)

Figure 20A:
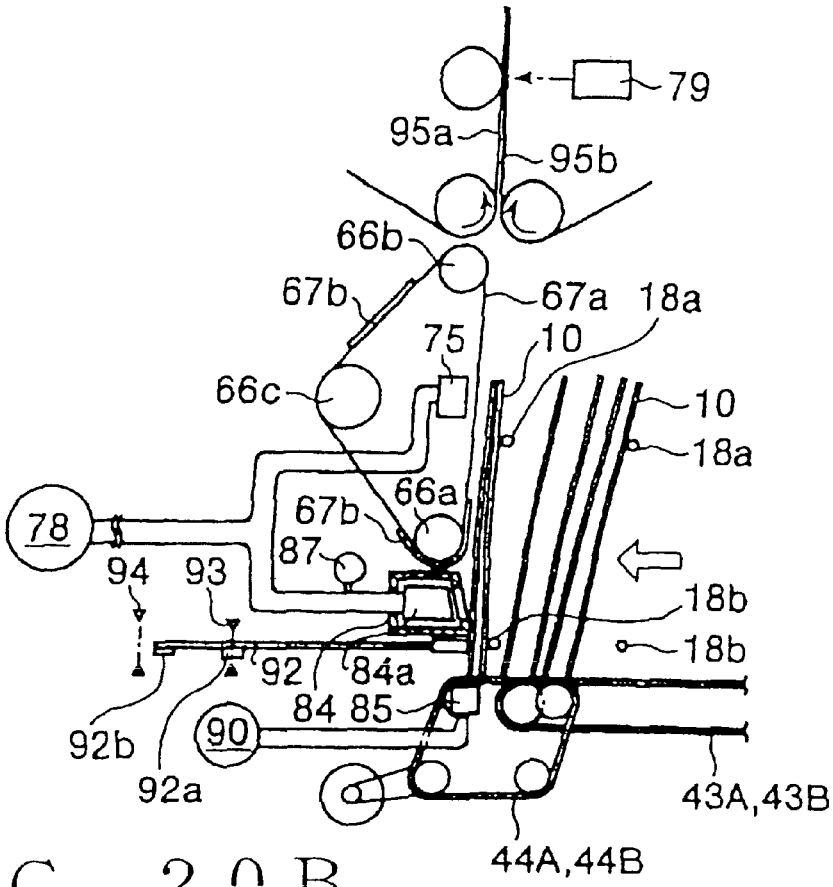
FIGS. 20A and 20B each illustratively show a peripheral construction of a paper-leaves separating/supplying apparatus according to the embodiment.
Figure 20B:
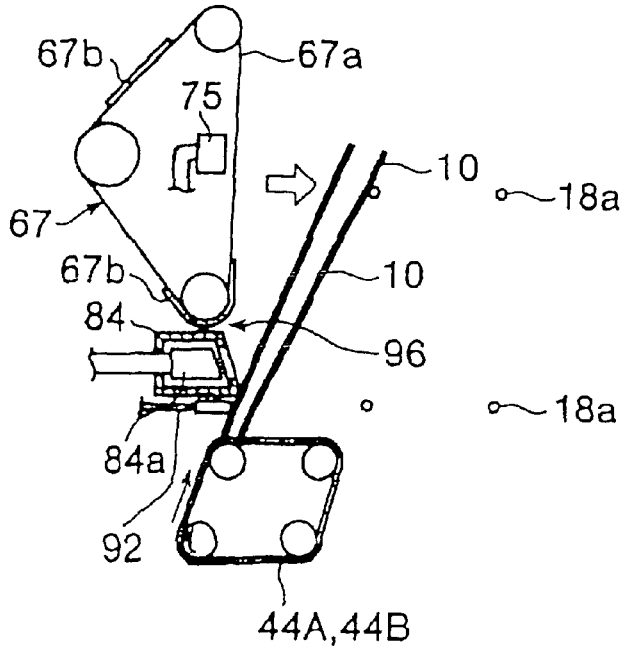
Figure 21:
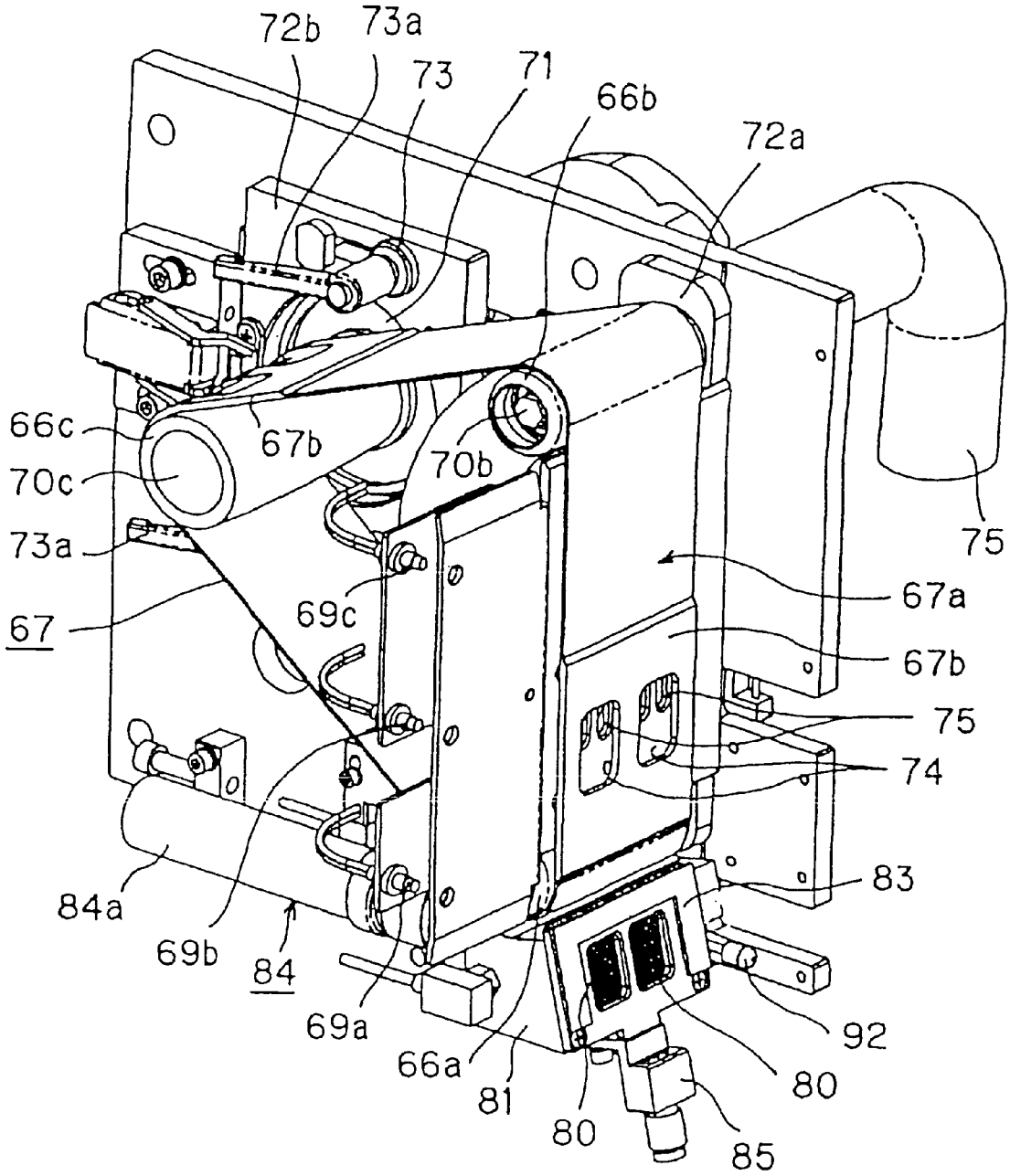
FIG. 21 is a perspective view entirely showing the paper-leaves separating/supplying apparatus according to the embodiment.
Figure 22:
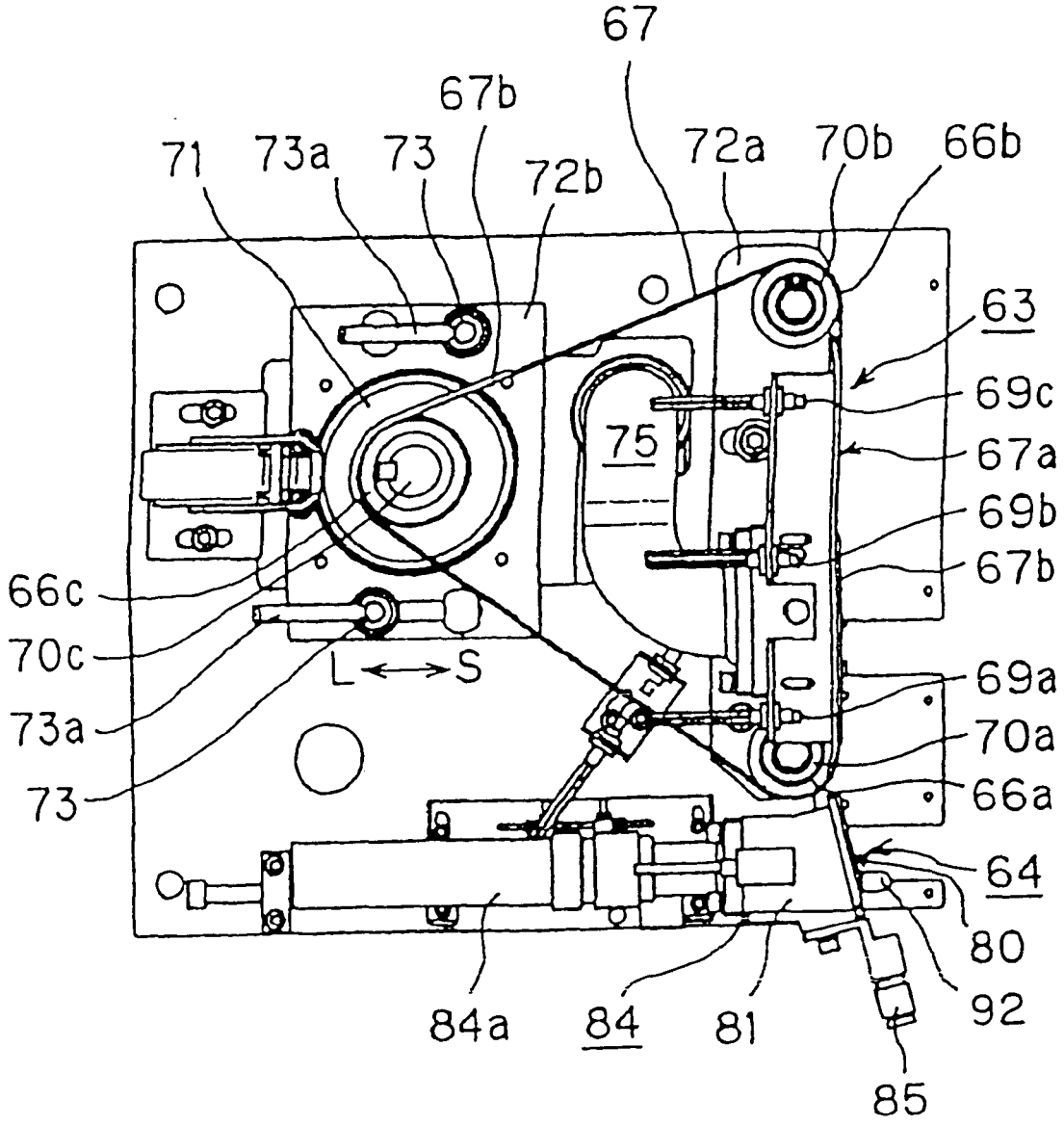
FIG. 22 is a front elevational view showing the paper-leaves separating/supplying apparatus according to the embodiment.
Figure 23:
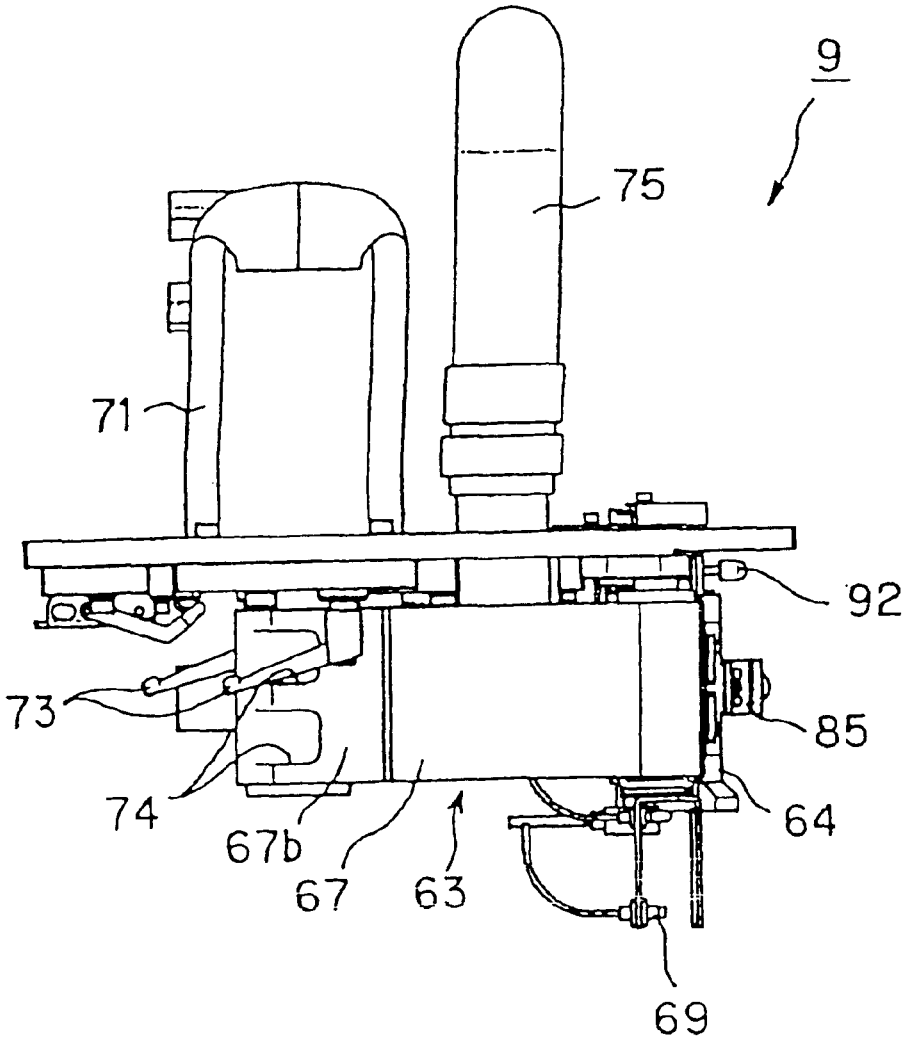
FIG. 23 is a top view showing the paper-leaves separating/supplying apparatus according to the embodiment.

Furthermore, a description will be given hereinbelow of a construction of the paper-leaves separating/supplying apparatus 9 which is for separating the paper leaves 10, conveyed to the paper-leaves feeding position 8, from each other and for feeding them toward the paper-leaves conveying means 4. The detail of the construction of the paper-leaves separating/supplying apparatus 9 is shown in FIGS. 5 and 20 to 23. FIG. 5 is a perspective view showing a peripheral structure of the paper-leaves separating/supplying apparatus 9 of the paper-leaves supplying section 1 at the paper-leaves feeding position 8, FIGS. 20A and 20B illustratively show an operation of the peripheral construction of a paper-leaves separating/supplying apparatus 9, FIG. 21 is a perspective view entirely showing the paper-leaves separating/supplying apparatus 9, FIG. 22 is a front elevational view showing the paper-leaves separating/supplying apparatus 9, and FIG. 23 is a top view showing the paper-leaves separating/supplying apparatus 9. In FIGS. 5 and 20A to 23, the paper-leaves separating/supplying apparatus 9 is made up of a separating/supplying device 63 for taking up the paper-leaves 10, conveyed to the paper-leaves feeding position 8 in a standup condition by the paper-leaves conveying means 12 and the second conveying means 16, one by one by vacuum suction and for conveying the paper leaf 10 in a generally perpendicular condition to the paper-leaves conveying means 4 existing on the downstream side, a separation auxiliary device 64 for facilitating the separation of the paper leaves 10 from each other in the separating/supplying device 63, a paper-leaves arrival detecting means 106 (see FIG. 28) for detecting the presence or absence of the paper leaf 10 conveyed to the paper-leaves feeding position 8, and a paper-leaves over-press detecting means 105 (see FIG. 28).

(Structure of Separating/Supplying Device)

Figure 28:
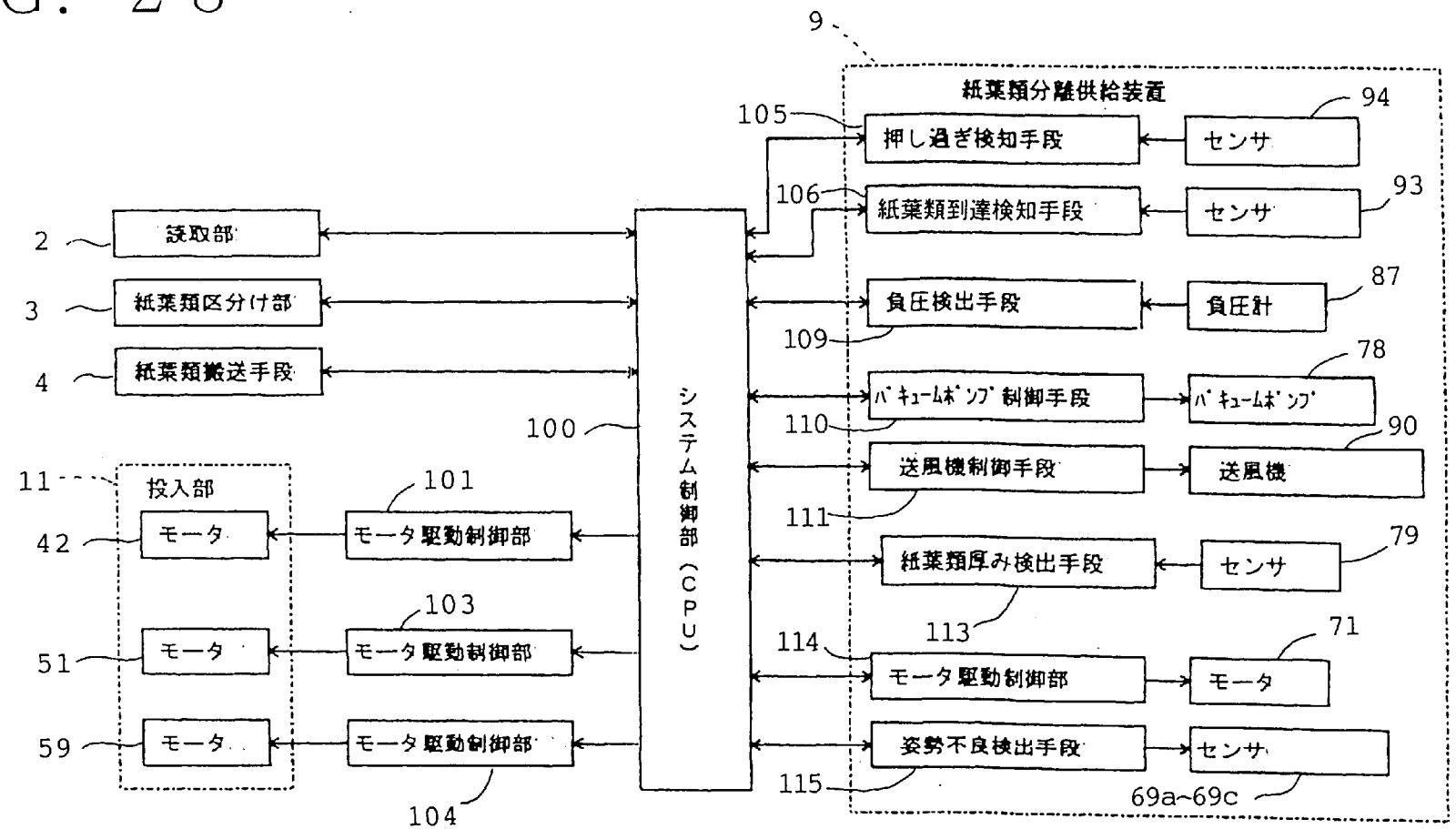
FIG. 28 is a block diagram showing a circuit arrangement of the entire paper-leaves conveying apparatus of the paper-leaves division system according to the embodiment.

The separating/supplying device 63 is composed of an endless separating/supplying belt 67 stretched around three guide rollers 66*a*, 66*b* and 66*c*, a vacuum suction means 68 for vacuum-catching the paper leaves 10, transferred up to this separating/supplying belt 67, to hold them on the separating/supplying belt 67, three sensors 69*a*, 69*b* and 69*c* for detecting the size of the paper leaves 10 transferred to the separating/supplying device 63, and the presence of paper leaves 10 transferred in a state put in posture disorder or placed in misarrangement, and for sending output information to a posture-disorder detecting means 115 (see FIG. 28).

Of the three guide rollers 66*a*, 66*b* and 66*c*, the two guide rollers 66*a* and 66*b* are disposed in a state separated vertically along a direction of feeding the paper leaves 10, while the remaining one guide roller 66*c* is located therebehind. Accordingly, a portion 67*a* (which will be referred to hereinafter as a "belt contact surface 67*a*") of the separating/supplying belt 67 stretched by the three guide rollers 66*a*, 66*b* and 66*c*, confronting the paper-leaves feeding position 8, is made to have a flat plane (perpendicular plane), thus straight traveling vertically. In addition, the guide rollers 66*a* and 66*b* are idler rollers rotatably attached to rotary shafts 70*a* and 70*b*, respectively, while the guide roller 66*c* is a driving roller fitted to a driving shaft 70*c*, rotated by a motor 71, to be rotatable together. When the driving shaft 70*c*, together with the guide roller 66*c*, is rotated by the motor 71, the separating/supplying belt 67, together with the guide roller 66*c*, is revolved in accordance with the rotation of the guide rollers 66*a* and 66*b*. The rotating direction thereof is the counterclockwise direction in FIGS. 5 and 20A to 23.

In addition, the driving shaft 70*c* is mounted on a movable holding plate 72*b* different from a fixed holding plate 72*a* to which attached are the rotary shafts 70*a* and 70*b* for supporting the guide rollers 66*a* and 66*b*. This movable holding plate 72*b*, together with the motor 71 and the driving shaft 70*c*, is made to be movable in a direction approaching the guide rollers 66*a* and 66*b*, indicated by an arrow S in FIG. 22 (direction to the interior of the separating/supplying belt 67) and in a direction of separating therefrom, indicated by an arrow L in FIG. 22. When it is moved in the separating direction indicated at the arrow L, the separating/supplying belt 67 around the guide rollers 66*a*, 66*b* and 66*c* is tightened strongly, and when being moved in the approaching direction indicated at the arrow S, the separating/supplying belt 67 is released from the tightness. In addition, the position of the movable holding plate 72*c* can be fixed, but releasable, by a locking means 73 having a locking lever 73*a*. Accordingly, with the structure of the separating/supplying device 63 according to this embodiment, when the movable holding plate 72*b* is released from the locked state by the locking means 73 and the guide roller 66*c*, together with the movable holding plate 72*b*, is shifted in the inside direction of the separating/supplying belt 67 so that the separating/supplying belt 67 loses the tightness, the replacement of the separating/supplying belt 67 or the like becomes possible in this state. After the replacement, the guide roller 66*c*, together with the movable holding plate 72*b*, is returned to the original position and locked there. Thus, it is possible to easily accomplish the replacement of the separating/supplying belt 67 or the like.

In the case of a conventional separating/supplying belt, in order to achieve certain separating/supplying operations, there is a need for the outer circumferential surface of the belt to have irregularities. Therefore, there may be a problem in that, in a case in which a tension roller is provided in the exterior of the belt to produce the inward tension, the irregularities on the outer circumferential surface of the belt can damage the tension roller. In addition, there has been known an auto-tension mechanism in which the tension roller is made to be movable and a spring is put to use. However, in this case, a continuous load acts on the spring itself so that the spring can be broken. Still additionally, in the case of a conventional belt replacement method, after the replacement, a belt tension depends on operator's sensation, and hence, a value is hard to set uniformly, or this requires a special tool. On the other hand, with the construction according to this embodiment, the movable holding plate 72*b* is released from the locked state by the locking means 73, and the guide roller 66*c*, together with the movable holding plate 72*b*, is shifted to the inside of the separating/supplying belt 67 so that the separating/supplying belt 67 loses the tightness, which enables easy replacement of the separating/supplying belt 67 and others. In addition, after the replacement, since the guide roller 66*c*, together with the movable holding plate 72*b*, can be returned to the original state and locked there, it is possible to easily accomplish the replacement of the separating/supplying belt 67, and others.

Furthermore, in the construction according to this embodiment, the guide rollers 66*a* and 66*b* forming the belt contact surface 67*a* pointing in the direction of conveying the paper leaves 10 are designed to take a fixed state after performing positional adjustment, which will be described later, in cooperation with the fixed holding plate 72. That is, since the guide rollers 66*a* and 66*b* are designed not to move at the belt replacement, the location of the belt contact surface 67*a* does not shift even at the belt replacement. If the belt contact surface 67*a* shifts at the paper-leaves feeding position 8, there is a need to again adjust the positional relationship between the aforesaid arms 18*a* and 18*b* of the paper-leaves conveying means 12 and the belt contact surface 67*a*, which causes complicated operations. In the construction according to this embodiment, the position of the belt contact surface 67*a* does not shift at the belt replacement; therefore, it is maintainable at the same position and in the same state. In addition, the guide roller 66*c* is designed to be moved together with the motor 71, the driving shaft 70*c* and the movable holding plate 52*b*, and irrespective of the movement of the guide roller 66*c*, the positional relationship with the motor 71 and the driving shaft 70*c* is securable at all times, which eliminates the need for re-adjusting (including re-assembling) the positional relationship with respect to the motor 71 and the driving shaft 70*c* after the replacement.

Moreover, the separating/supplying belt 67 is disposed so that the belt contact surface 67*a* is placed at right angles to the horizontal plane (bottom wall 11*a*) or placed in a state slightly (θ1) inclined toward the depositing section 11 side. The angular adjustment of the belt contact surface 67*a* can arbitrarily be made with respect to the bottom surface 11*a* by rotating the fixed holding plate 72*a*, which holds the guide roller 66*a* and 66*b* to allow them to be rotatable, clockwise or counterclockwise in FIG. 22. This angular adjustment is made once at manufacturing and assembling, and thereafter, it is placed in a fixed condition. In the construction according to this embodiment, the reason that the belt contact surface 67*a* is placed at right angles to the bottom wall 11*a* or placed in a state inclined toward the depositing section 11 side is to eliminate the contact pressure between the preceding paper leaf 10 and the succeeding paper leaf 10 which occurs when, subsequent to the preceding paper leaf brought into contact with the belt contact surface 67*a* of the separating/supplying belt 67, the succeeding paper leaf 10 comes and the weight (self-weight) of the succeeding paper leaf 10 falls on the preceding paper leaf 10. That is, in a case in which the preceding paper leaf 10 is held prependicularly (at right angles), or in a state inclined, at the belt contact surface 67*a*, it is possible to prevent the weight of the succeeding paper leaf from being applied to the preceding paper leaf 10. Accordingly, since the construction of the separating/supplying device 63 according to this embodiment can eliminate the external force which is a large contact pressure between the preceding paper leaf 10 and the succeeding paper leaf 10 occurring when the weight of the succeeding paper leaf 10 falls on the preceding paper leaf, the separating/supplying belt 67 can smoothly feed the preceding paper leaf 10. In addition, it is possible to prevent the succeeding paper leaf 10 from being put in disorder because of being dragged by the preceding paper leaf 10, and when the succeeding paper leaf 10 is fed subsequently, the succeeding paper leaf 10 is preventable from being fed in an unstable posture. This secures smooth feeding of the paper leaf 10 without the occurrence of troubles. Incidentally, two paper-leaves suction-holding members 67*b* each having a pair of suction windows 74 in front and in rear for attracting the paper leaves 10 by vacuum suction are placed on the separating/supplying belt 67 in a state disposed separately by 180 degrees, with no air communication being made at portions other than the suction windows 74.

The vacuum suction means 68 of the separating/supplying device 63 has suction ducts 75 placed behind the belt contact surface 67*a* in the interior of the separating/supplying belt 67, with the suction ducks 75 being connected to a vacuum pump 78. In addition, the suction ducts 75 are placed to confront the suction windows 74 of the paper-leaves suction-holding members 67*b* of the separating/supplying belt 67, and an intake opening is covered with the separating/supplying belt 67 when the separating/supplying belt 67 is placed in rotary motion so that the suction windows 74 do not come in front of the suction ducts 75, and when the suction windows 74 arrive in front of the suction ducts 75, the intake opening is opened so that air comes in the suction ducts 75 due to the suction force from the vacuum pump 78. At this time, the paper leaf 10 transferred to a position adjacent to the paper-leaves suction-holding member 67*b* is taken up in a state adhering onto a surface of the paper-leaves suction-holding member 67*b* to again cover the intake opening and, together with the separating/supplying belt 67, is transferred in an upward direction, that is, it is transferred vertically toward the paper-leaves conveying means 4. The suction duct 75 has an elongated configuration in the traveling direction of the separating/supplying belt 67, and the paper leaf 10, being transferred upwardly with the separating/supplying belt 67 in a state attracted through the suction windows 74, is carried until it is held between conveying belts 95*a* and 95*b* of the paper-leaves conveying means 4. In addition, the separating/supplying belt 67 is not placed in rotary motion at all times, but commonly stands by at the home position where the paper-leaves suction-holding member 67*b* is separated from the front surface of the suction duct 75, and it covers the front surface of the intake opening of the suction duct 75. When the sensor 93 detects that the paper leaf 10 arrives at the paper-leaves feeding position 8, the motor 71 is rotated to revolve the separating/supplying belt 67, and when this separating/supplying belt 67 is revolved 180 degrees to reach the home position, the rotation of the motor 71 stops to cease the separating/supplying belt 67. In addition, while the separating/supplying belt 67 makes 180-degree revolution, the suction windows 74 once pass by the suction ducts 75, thus performing the feeding of the paper leaves 10 once. That is, one paper leaf 10 is fed according to 180-degree movement. Incidentally, in this embodiment, although two paper-laves suction-holding members 67*b* are provided on the separating/supplying belt 67 at an interval of 180 degrees, in the case of the use of one paper-laves suction-holding member 67*b*, one paper leaf 10 is fed according to 360-degree revolution. Moreover, depending on the dimension of the separating/supplying belt 67, it is also possible to use three or more paper-leaves suction-holding members 67*b*.

Figure 27:
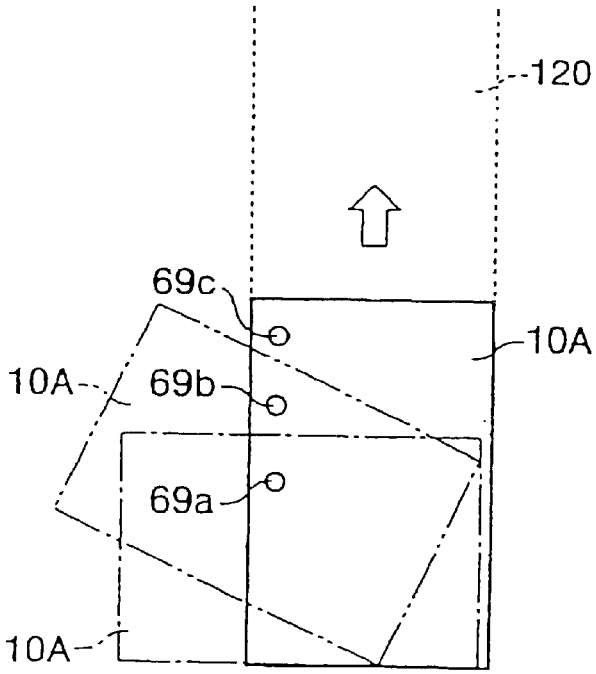
FIG. 27 is an illustration for explaining an unacceptable posture detecting operation according to the embodiment.

The three sensors 69*a*, 69*b* and 69*c* for the posture-disorder detecting means 115 is of a reflection type, and as illustratively shown in FIG. 27, they are disposed to be scattered along the conveying direction in the substantially maximum width portion of a conveyance area 120 into which the paper leave A10 available in this paper-leaves division apparatus is normally fed in a state attracted by the separating/supplying belt 67. The posture-disorder detecting means 115 using these sensors 69*a* to 69*c* makes a decision that the paper leaf A10 is in a properly positioned condition, indicated by a solid line in FIG. 27, when the three sensors 69*a* to 69*c* detect it simultaneously. On the other hand, the posture-disorder detecting means 115 makes a decision that the paper leaf A10 is in a posture-disorder condition by being pushed down or titled, see the paper leaf A10 indicated by a dashed line or as the paper leaf A10 indicated by two-dot chain line, when only one sensor 69*a* of the three sensors 69*a* to 69*c* detects it (the paper leaf A10 indicated by the dashed line) or when only two sensors 69*a* and 69*b* detect it (the paper leaf A10 indicated by the two-dot chain line). At this time, the output information from the posture-disorder detecting means 115 is forwarded to a system control section 100 (FIG. 28) which will be described later, and the system control section 100 issues alarm or the like and, at the same time, stops the apparatus, thus informing the operator of this trouble. Accordingly, it is possible to prevent the paper leaves 10 from being fed in a posture-disordered condition from the separating/supplying device 63.

The separation auxiliary device 64 is positioned under the separating/supplying device 63, and includes a housing 81 having an auxiliary suction window 80 (this portion will be referred to hereinafter as an "auxiliary contact surface 80") serving as an auxiliary contact surface open to a direction in which the paper leaves 10 are conveyed by the paper-leaves conveying means 12, and an intake opening of a suction duct 84*a* acting as an auxiliary vacuum suction means 84 is made in the housing 81. The suction duct 84*a* uses, as a suction source, the vacuum pump 78 as well as the suction ducts 75 of the vacuum suction means 68, and the suction passage from the vacuum pump 78 is halfway branched into an intake passage extending to the suction duct 75 side and an intake passage extending to the suction duct 84*a* side. A negative-pressure sensor 87 is provided in the suction duct 84*a* to measure a negative pressure in the interior of the suction duct 84*a*. In addition, in the relationship between the intake area of the suction duct 84*a* in the auxiliary suction means 84 and the intake area of the suction duct 75 in the vacuum suction means 68, the intake area of the suction duct 84*a* in the auxiliary suction means 84 is set to be larger than the intake area of the suction duct 75 in the vacuum suction means 68. Still additionally, the auxiliary contact surface 80 is not arranged in a linear relation to the belt contact surface 67*a* of the separating/supplying belt 67, but the lower side thereof somewhat protrudes toward the depositing section 11 side, and the connection between the contact surface 67*a* and the auxiliary contact surface 80 is made in a generally doglegged condition. Moreover, as shown in detail in FIGS. 24 to 26, a net 82 with an air permeability is placed in front of the auxiliary contact surface 80 to cover the front surface thereof, and a U-shaped frame 83 is placed outside. This frame 83 forms an irregular portion outside the auxiliary contact surface 80, and the frame 83 makes a convexity while the internal side surrounded by the frame 83 makes a concavity. The lower end portion of the frame 83 is set not to reach a lower portion 83*a* of the auxiliary contact surface 80.

Figure 24:
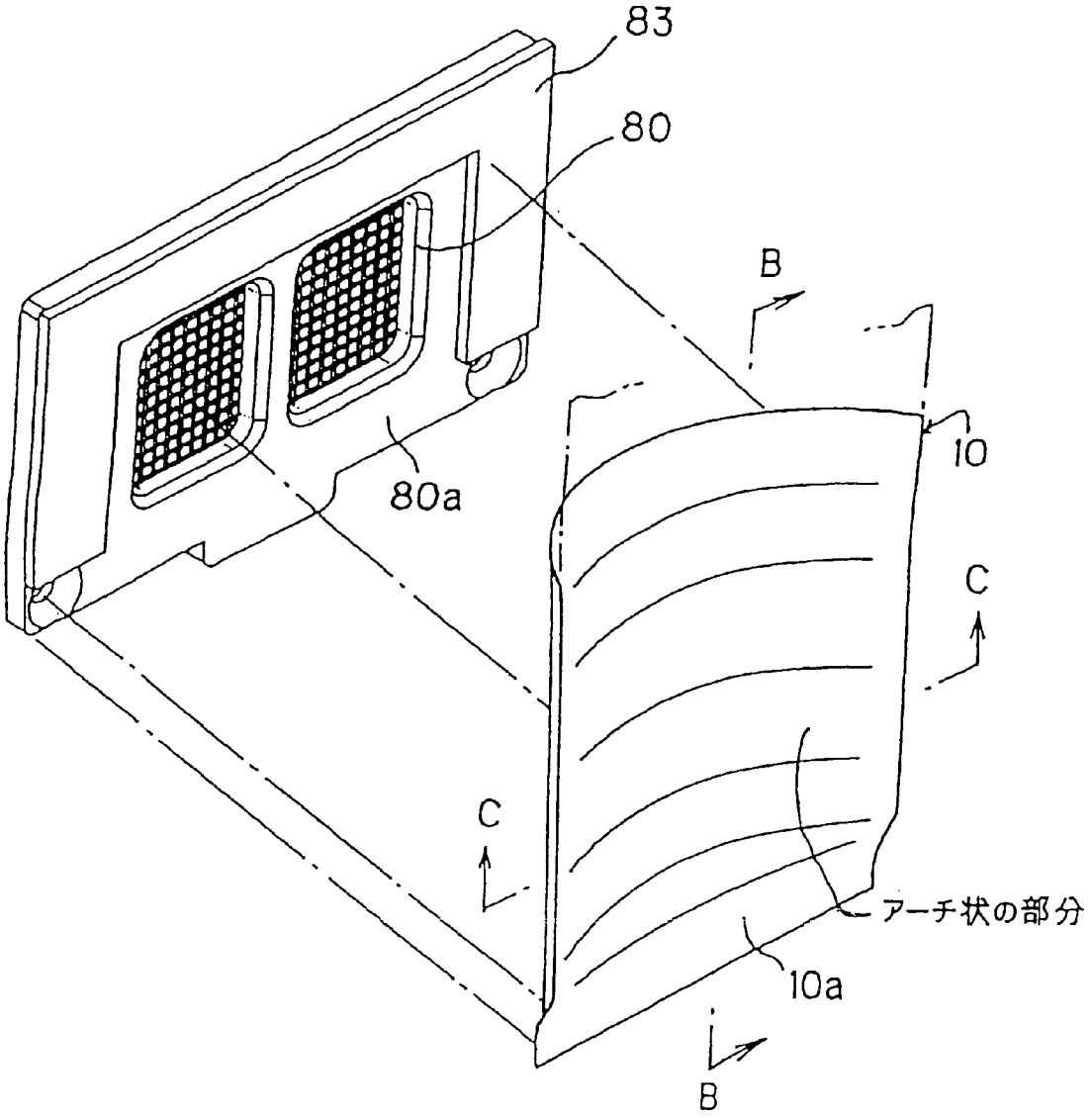
FIG. 24 is a perspective view showing an essential construction of a separation auxiliary device according to the embodiment.
Figure 25:
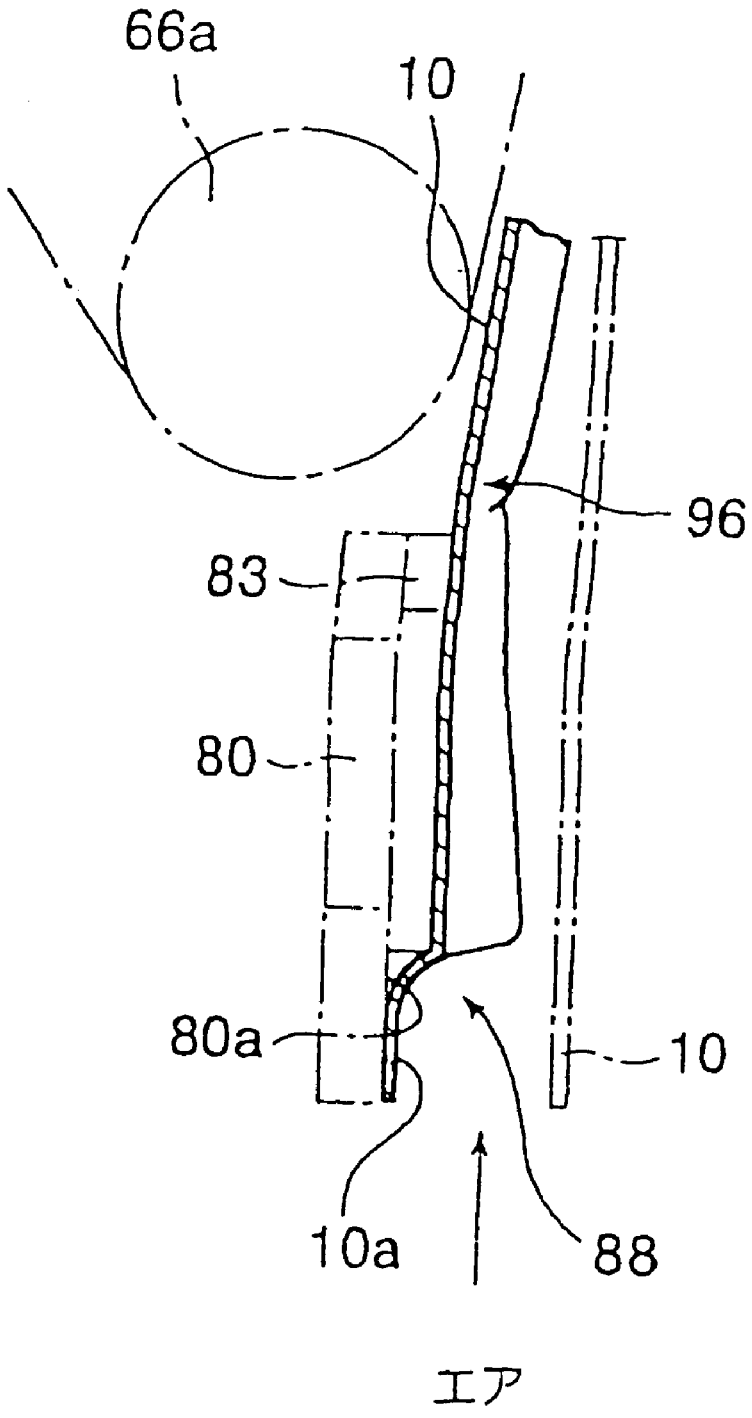
FIG. 25 is a cross-sectional view taken along an arrow line B—B of FIG. 24.
Figure 26:
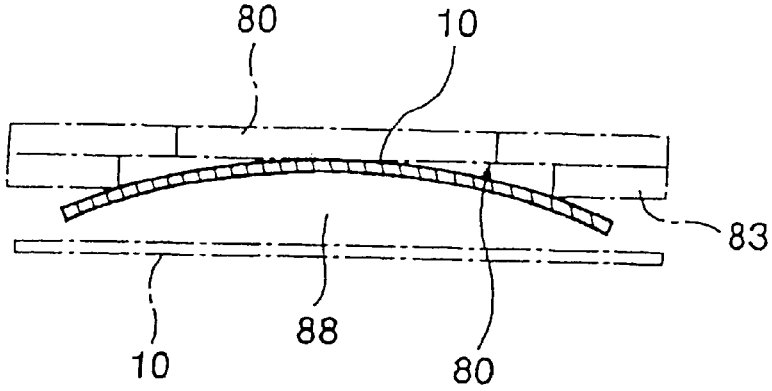
FIG. 26 is a cross-sectional view taken along an arrow line C—C of FIG. 24.
Figure 30:
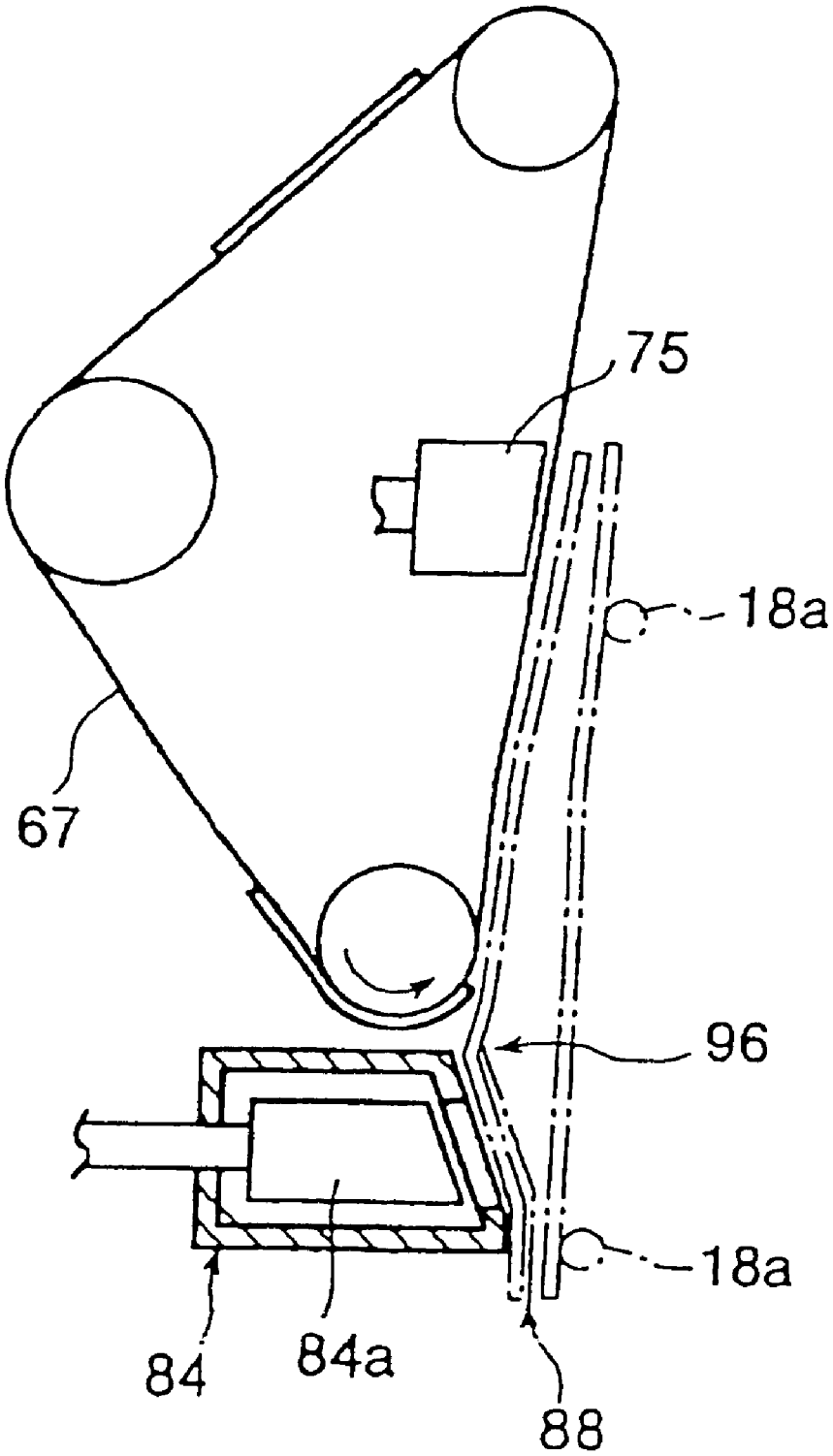
FIG. 30 is an illustrative view showing an essential construction of a paper-leaves separating/supplying apparatus according to the embodiment.

When the paper leaf 10 arrives at the paper-leaves feeding position 8, a lower end portion of the paper leaf 10 is vacuum-sucked by the suction duct 84*a* and is attracted to adhere onto the auxiliary contact surface 80, which covers the intake opening of the suction duct 84*a*. Due to this attraction, the lower end portion thereof is bent as shown in FIGS. 24 to 26. In more details, FIG. 24 is an exploded perspective view of an essential construction, showing a state in which a lower end portion of the paper leaf 10 is attracted onto the auxiliary contact surface 80, FIG. 25 is a cross-sectional view taken along an arrow line B—B of FIG. 24, and FIG. 26 is a cross-sectional view taken along an arrow line C—C of FIG. 24. In FIGS. 24 to 26, since the frame 83 forms convex portions at the both end (front and rear) portions and upper portion of the auxiliary contact surface 80, the central portion of the paper leaf 10 protrudes to the auxiliary contact surface 80 side and both the end portions of the paper leaf 10 protrude to the succeeding paper leaves 10 side, which forms a horizontal cross-section bent into a generally arch-like configuration to produce a warp. In this case, since the frame 83 is not placed at a lower end portion 80*a* of the auxiliary contact surface 80 to form a flat plane, the lowermost portion of the paper leaf 10 corresponding to a portion 80 thereof forms a flat portion 10*a*. If the flat portion 10*a* is made under the arched portion in this way, a gap 88 established with respect to the succeeding paper leaf 10 is prolonged, and air for peeling, which will be described later, is given to this gap 88. Accordingly, in the structure of the auxiliary contact surface 80 section thus made, when the lower end portion of the paper leaf 10 conveyed to the paper-leaves feeding position 8 is suction-adhered to the auxiliary contact surface 80 to be warped, even if the succeeding paper leaf 10 is conveyed in an overlapping condition, the warping produces a flipping effect for the peeling and forms the gap 88 (see FIGS. 25 and 26) with respect to the succeeding paper leaf 10, thus making the succeeding paper leaf 10 stay without the occurrence of the adhesion therebetween. At the same time, since, at a portion 96 (see FIGS. 26 and 30) between the auxiliary contact surface 80 and the belt contact surface 67*a* of the separating/supplying belt 67, an angle is made to form a doglegged configuration, the paper leaf 10 suction-adhered to the auxiliary contact surface 80 is bent between the auxiliary contact surface 80 and the belt contact surface 67, and as illustratively shown in FIGS. 25 and 30, this bent portion 96 also defines a gap with respect to the succeeding paper leaf 10.

In addition, a blast duct 85, associated with the formed portion of the gap 88, is located under the gap 88 portion to jet air toward the gap 88. The air from the blast duct 85 strikes on the gap 88 from the under to positively make the separation between the paper leaves 10 and 10 so that only the first paper leaf 10 is held and transferred by the separating/supplying belt 67. Still additionally, since the aforesaid flat portion 10*a* is made at the lower end portion of the paper leaf 10 brought into contact with the auxiliary contact surface 80 to secure a large opening for accommodating air, the gap 88 can accept a large amount of air from the blast duct 85, thus efficiently achieving the peeling of the succeeding paper leaf 10. The blast duct 85 is connected through a valve 89 to an air blower 90.

The paper-leaves arrival detecting means 106 and the paper-leaves over-press detecting means 105 are located under the separation auxiliary device 64. A contact 92 is placed to extend to the interior of the depositing section 11 in the paper-leaves 10 conveying direction, and an arrival sensor 93 for the paper-leaves arrival detecting means 106 and an over-press sensor 94 for the paper-leaves over-press detecting means 105 are placed behind the contact 92. In addition, a shade 92*a* for the arrival detecting sensor and a shade 92*b* for the over-press detecting sensor are placed in a part of the contact 92. When the paper leaf 10 is absent at the paper-leaves feeding position 8, the contact 92 protrudes a great deal to the interior of the depositing section 11, and each of the shades 92*a* and 92*b* is positioned at a position separated from each of the arrival sensor 93 and the over-press sensor 94. When the paper leaf 10 is conveyed to the paper-leaves feeding position 8 by means of the paper-leaves conveying means 12 and the second paper-leaves conveying means 16 and the contact 92 is pressed by that paper leaf 10 to retreat, the shade 92*a* is first put in the interior of the arrival sensor 93 so that the arrival sensor 93 detects that the paper leaf 10 arrives at the paper-leaves feeding position 8. The arrival sensor 93 forwards a signal to the paper-leaves arrival detecting means 106 (see FIG. 28). Thus, the paper-leaves arrival detecting means 106 can detect the arrival of the paper leaf 10. In addition, when the paper leaf 10 is transferred in a proper condition without being excessively pressed against the separating/supplying belt 67 side, the contact 92 is maintained in that state without further retreating. On the other hand, if the paper leaves 10 are conveyed successively in an overlapped condition and then stopped up, the contact 92 further retreats and the shade 92*b* advances to the interior of the over-press sensor 94 and, hence, the over-press sensor 94 detects the fact that the paper leaf 10 is in an excessively pressed condition, and sends a signal to the over-press detecting means 105 (see FIG. 28). Thus, the over-press detecting means 105 detects the over-press condition.

(Construction of Paper-Leaves Conveying Means Side)

The paper-leaves conveying means 4 includes a driving system side conveying belt means 95*a* and an idler system side conveying belt means 95*b* placed to be adjacent to the belt contact surface 67*a* of the separating/supplying belt 67 and to be in opposed relation to each other. This paper-leaves conveying means 4 is made such that the paper leaves 10 fed vertically by the separating/supplying belt 67 are led between the driving system side conveying belt means 95*a* and the idler system side conveying belt means 95*b* to be carried through the reading unit 2 to the partitioning/stacking units 3*a* side.

In addition, inside the conveying belt means 95*b*, there is provided a thickness sensor 79 for the paper-leaves thickness detecting means 113 (see FIG. 28), which is for detecting the thickness of the paper leaf 10 fed by the separating/supplying belt 67 to pass between the conveying belt means 95*a* and 95*b*. The thickness sensor 79 is of a reflection type, and is made to send, to the paper-leaves thickness detecting means 113, a signal corresponding to a varying quantity of the belt of conveying belt means 95*b* when the paper leaf 10 passes between the conveying belt means 95*a* and 95*b*. The paper-leaves thickness detecting means 113 detects the thickness of the paper leave 10 on the basis of the output information from the thickness sensor 79 and sends the thickness information to the system control section 100. The system control section 100 calculates, on the basis of the information from the paper-leaves thickness detecting means 113, an optimum speed to be taken in continuously sending the paper leaves 10 to the paper-leaves feeding position 8 by means of the paper-leaves conveying means 12 and the second paper-leaves conveying means 16, and performs feedback control. In this case, for example, different gaps between the succeeding paper leaf 10 and the belt contact surface 67*a* take place at the paper-leaves feeding position 8 for when high-thickness paper leaves 10 are fed by the separating/supplying belt 67 and for when low-thickness paper leaves 10 are fed thereby. That is, among the paper leaves 10 being transferred, there are high-thickness paper leaves to low-thickness paper leaves. Accordingly, there is a need to execute the conveying speed control of the paper-leaves conveying means 12 for sending the paper leaves by a quantity corresponding to the thickness of the paper leaf 10. If the paper-leaves conveying means 12 sends the paper leaves 10 at a constant speed irrespective of the thickness information, in order to avoid the excessively pressed condition, it is required to send the paper leaves 10 according to a conveying speed corresponding to the thinnest paper leaves 10. However, in this case, when thick paper leaves are fed, a wasteful time of several seconds is taken thereafter. In order to enhance the speed-up of the mechanical handling ability, the thickness of the paper leaf immediately after fed is detected so that the thickness information is used for the control of the paper-leaves conveying means 12. Thus, in the construction according to this embodiment, the thickness of the paper leaves 10 immediately after fed is detected to employ that thickness information for controlling the paper-leaves conveying means 12, thus achieving the speed-up of the mechanical handling ability.

(Circuit Arrangement)

FIG. 28 is a block diagram showing the entire circuit arrangement of the paper-leaves transferring apparatus of a paper-leaves division system. In FIG. 28, the same reference numerals as those in FIGS. 1 to 27 represent the same parts. In FIG. 28, the entire paper-leaves conveying apparatus is under control of the system control section (CPU) 100, and to the system control section 100 there are connected the reading unit 2, the paper-leaves partitioning section 3, the paper-leaves conveying means 4, the depositing section 11 and the paper-leaves separating/supplying apparatus 9. In addition, the motor 42 for driving the endless chain 21 in the depositing section 11 is also connected through a motor drive control unit 101 to the system control section 100, while the motor 51 for operating the auxiliary conveying belt means 44A and 44B is connected through a motor control unit 103 to the system control section 100, and further, the motor 59 operative to drive the paper-leaves vibrating means 15 is connected through a motor drive control unit 104 to the system control section 100. Still additionally, in the paper-leaves separating/supplying apparatus 9, the over-press sensor 94 is connected through the over-press detecting means 105 to the system control section 100, the sensor 93 for detecting the arrival of the paper leaf 10 is connected through the paper-leaves detecting means 106 to the system control section 100, the vacuum pump 78 is connected through a vacuum pump control means 110 to the system control section 100, the air blower 90 is connected through an air blower control means 111 to the system control section 100, the thickness sensor 79 for detecting the thickness of the paper leaves 10 is connected through the paper-leaves thickness detecting means 113 to the system control section 100, and the motor 71 operative to drive the separating/supplying belt 67 of the separating/supplying device 63 is connected through a motor drive control unit 114 to the system control section 100.

(Essential Part Control Operation)

Figure 29A:
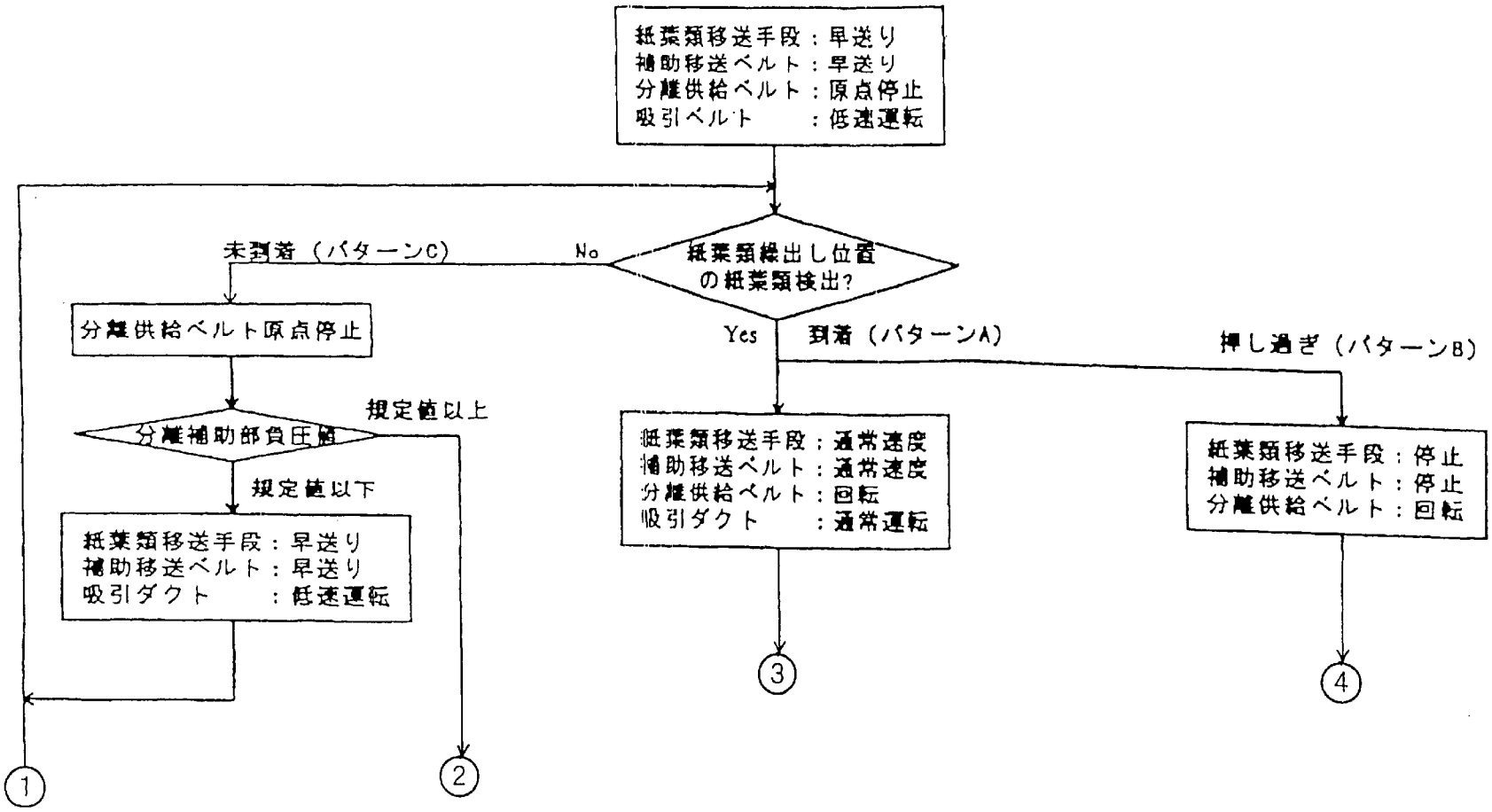
FIGS. 29A and 29B are partial illustrations of a flow chart showing an essential operation of the paper-leaves division system according to the embodiment as a whole.
Figure 29B:
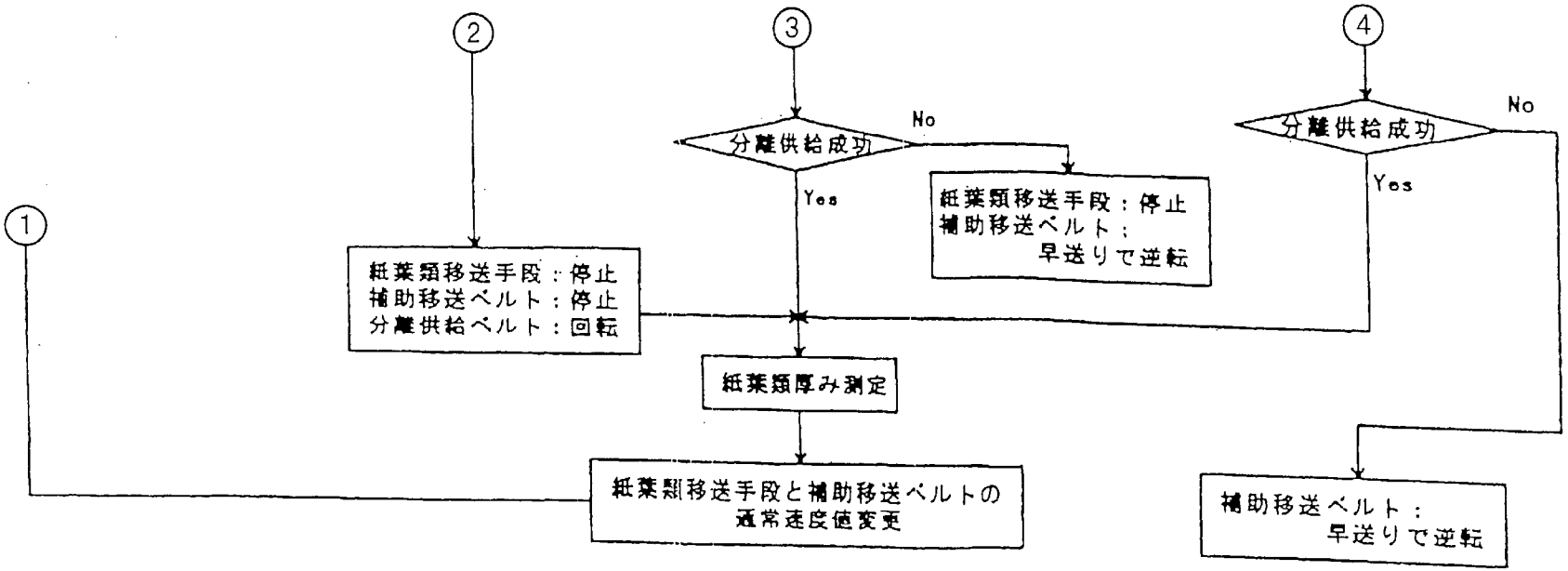

FIGS. 29A and 29B are flow charts showing an operation of an essential part of the paper-leaves supplying section of the paper-leaves division system. Referring to the flow of FIGS. 29A and 29B, a description will be given hereinbelow of a paper-leaves supplying operation according to this embodiment. Prior to the description of the operation, in the construction according to this embodiment, the suction source for the suction duct 75 (vacuum suction means 68) on the separating/supplying device 63 side and the suction source for the suction duct 84*a* (auxiliary suction means 84) on the separation auxiliary device 64 side are made using one supply source and the principle of the operation in this construction will first be described.

In this construction, the suction duct 75 and the suction duct 84*a* are halfway branched from the same suction source (vacuum pump 78), and when the openings of the suction duct 75 and the suction duct 84*a* appear, both the suction block internal pressures are in the balanced condition and equal to each other. Even though an environment variation occurs, for example, even if any one of them falls into the open or closed condition, although the internal pressures become different from before, they instantaneously return to the balanced condition, that is, become equal to each other. In addition, when the intake opening of any one of them is in an open condition, since a large amount of air is supplied for the vacuum attraction at that intake opening, the vacuum attraction effect is neutralized so that both are balanced at the smaller internal pressure value. This is called leak or atmospheric pressure release.

Accordingly, the operation to be taken from when the paper leaf 10 arrives at the paper-leaves feeding position 8 until the paper leaf 10 is fed through the separating/supplying belt 67 toward the paper-leaves conveying means 4 is as follows (1) to (4). The separating/supplying belt 67 of the separating/supplying device 63 is placed at a position (which will be referred to hereinafter as a "home position") where the suction window 74 of the paper-leaves suction-holding member 67*b* separates from the front surface of the suction duct 75 and a portion of the separating/supplying belt 67 other than the suction window 75 closes the suction opening of the suction duct 75, until the paper leaf 10 is detected by the paper-leaves detecting means 92 or the negative-pressure detecting means 109 at the paper-leaves feeding position 8.

(1) When the paper leaf 10 does not reach the paper-leaves feeding position 8 and the suction opening of the suction duct 75 is covered with the separating/supplying belt 67, that is, the separating/supplying belt 67 is in the stand-by condition, since the suction duct 84*a* is open to the atmosphere, both the internal pressures are balanced at the smaller value. Therefore, an excessive load does not act on the vacuum pump 78 serving as the suction source.

(2) When the paper leaf 10 is conveyed to the paper-leaves feeding position 8 to come into contact with the auxiliary contact surface 80, since the suction duct 75 and the suction duct 84*a* are in a hermetically sealed condition, both the internal pressures are balanced at the higher value. Following this, when the separating/supplying belt 67 is put in rotary motion so that the suction window 74 of the paper-leaves suction-holding member 67 confronts the paper leaf 10 in front of the suction duct 75, the paper leaf 10 is attracted by the suction window 74 to keep the covered condition of the front surface of the suction duct 75. In this case, since the intake opening area of the suction duct 75 of the vacuum suction means 68 is set to be larger than the intake opening area of the suction duct 84*a* of the auxiliary suction means 84, on the revolution of the separating/supplying belt 67, the preceding paper leaf 10 is fed in a state adhered to the suction window 74 owing to a large attracting force generated by the vacuum suction means 68 (suction duct 75). ((attracting force=(suction opening internal pressure)×(suction opening area))

(3) Since the preceding paper leaf 10 is fed in a state suction-adhered onto the separating/supplying belt 67 by the vacuum suction means 68 (suction duct 75), when the separation of a bundle of paper leaves 10 starts, the suction duct 84*a* of the auxiliary suction means 84 is released from the hermetically sealed condition, slight atmospheric pressure release occurs to reduce the internal pressure. Therefore, it is possible to smoothly conduct the operation that the preceding paper leaf 10 is released from the attraction by the auxiliary suction means 84.

(4) The succeeding paper leaf 10 transferred by the paper-leaves conveying means 12, the conveying belt means 43A and 43B of the paper-leaves conveying means 16 and the auxiliary conveying belt means 44A and 44B immediately after that is brought into contact with the auxiliary contact surface 80. Therefore, the suction duct 75 and the suction duct 84*a* fall into the hermetically sealed condition and, hence, both the internal pressures thereof are balanced at the higher value. Accordingly, the succeeding paper leaf 10 suction-attracted through the suction duct 84*a* is held so as not to be fed at an unstable timing, and the preceding paper leaf 10 being fed is separated and supplied by a large force. In other words, the paper-leaves feeding is achieved by substantially valve opening/closure control using the paper leaf 10 itself.

Meanwhile, when a plurality of paper leaves 10 are deposited together in a bundle in the depositing section 11 of the paper-leaves supplying section 1, they are subdivided and set between the partitioning arm devices 19 and the partitioning arm devices 19 in a stand-up condition and supported from both the sides by the arms (18*a*, 18*b* and 18*a*, 18*b*) of the partitioning arm devices 19. When no paper leaf 10 is detected by the paper-leaves arrival detecting means 106 or the negative-pressure detecting means 109 at the paper-leaves feeding position 8, each of the paper-leaves conveying means 12, the conveying belt means 43A, 43B of the second paper-leaves conveying means 16 and the auxiliary conveying belt means 44A, 44B is operated at a higher speed than that in the ordinary state. At this time, the paper leaves 10 deposited in the depositing section 11 undergo the vibrations by the paper-leaves vibrating means 15 to be put in order, and are conveyed to the paper-leaves feeding position 8 at the higher speed in the stand-up condition by means of the paper-leaves conveying means 12, the conveying belt means 43A, 43B of the second paper-leaves conveying means 16 and the auxiliary conveying belt means 44A, 44B.

When the paper leaf 10 is conveyed to the paper-leaves feeding position 8 at the higher speed and is detected by the paper-leaves arrival detecting means 106 or the negative-pressure detecting means 109, then the speed of each of the paper-leaves conveying means 12, the conveying belt means 43A, 43B of the second paper-leaves conveying means 16 and the auxiliary conveying belt means 44A, 44B is synchronized with that of the paper-leaves feeding operation in the separating/supplying device 63, thus implementing the above-mentioned feedback control.

On the other hand, the separating/supplying belt 67 of the separating/supplying device 63, as mentioned above, stays to close the suction hole 75 in order to prevent the paper leaves from jumping to the suction hole 75 and being separated and fed until the paper leaf 10 arrives at the paper-leaves feeding position 8 and is detected by the paper-leaves arrival detecting means 106 or the negative-pressure detecting means 109, and the output of the vacuum pump 78 is placed in a saving condition (low-speed operation). Thus, when the vacuum suction is not required actually, the output of the vacuum pump 78 is placed in the saving condition, thereby reducing unnecessary noise and the power consumption. At the same time, this can lengthen the life of the vacuum pump 78 because of the reduction of the load imposed on the vacuum pump 78. In addition, when the paper leaf 10 arrives at the paper-leaves feeding position 8 and is detected by the paper-leaves arrival detecting means 106, the vacuum pump 78 is released from the output saving condition to enter in the ordinary operation. Still additionally, the separating/supplying belt 67 is placed in rotary motion to separate and feed the paper leaves 10. Since both the intake openings of the suction ducts 75 and 84 enter the covered condition so that the internal pressures become rapidly high, and even in the case of the detection thereof by the negative pressure detecting means 109, a decision is made that the paper leaf 10 has arrived at the paper-leaves feeding position 8, with the result that the vacuum pump 78 is released from the controlled output, thus returning to the ordinary operation, and the separating/supplying belt 67 is put in the rotary motion to separate and feed the paper leaves 10.

The control to be implemented thereafter involves handling (pattern A) to be taken for when the paper leaf 10 conveyed to the feeding position is detected by the paper-leaves arrival detecting means 106, handling (pattern B) to be conducted for when, although the paper leaf 10 is detected by the paper-leave arrival detecting means 106, an over-press condition is detected by the paper-leaves over-press detecting means, and handling (pattern C) to be conducted for when, although the paper leaf 10 is not detected by the paper-leaves arrival detecting means 106, the negative-pressure sensor 87 indicates a negative pressure value exceeding a predetermined value and the negative-pressure detecting means 109 detects that negative pressure condition. The handling in these patterns A, B and C will be described hereinbelow.

(Pattern A)

When the paper leaf 10 arrives at the paper-leaves feeding position 8 to press the contact 92, the contact 92 is retreated so that the shade 92*a* enters the sensor 93. At this time, the paper-leaves arrival detecting means 106 can seize, on the basis of this output information, that the paper leaf 10 has been conveyed to the paper-leaves feeding position 8. When the paper-leaves detecting means 106 detects the paper leaf 10, the speed of conveyance by the paper-leaves conveying means 12, the conveying belt means 43A, 43B of the second paper-leaves conveying means 16 and the auxiliary conveying belt means 44A, 44B is returned to the ordinary speed synchronized with the feeding operation of the paper leaves 10 by the separating/supplying belt 67. Simultaneously, the vacuum pump 78 is released from the limited operation, while the separating/supplying belt 67 is placed in rotary motion and the paper leaves 10 are suction-held by the paper-leaves suction-holding members 67*b* and are fed to between the conveying belt means 95*a* and 95*b* of the paper-leaves conveying means 4. While passing between the conveying belt means 95*a* and 95*b* of the paper-leaves conveying means 4, the paper leaves 10 undergo the thickness detection on the basis of the output information from the paper-leaves thickness sensor 79, and the system control section 100 corrects, on the basis of the thickness, the conveying speed of the paper-leaves conveying means 12 and the conveying belt means 43A, 43B of the second paper-leaves conveying means 16, and implements the above-mentioned feedback control. In this case, the feeding speeds of the paper-leaves conveying means 12 and the conveying belt means 43A and 43B of the second paper-leaves conveying means 16 are equal to each other, and are set to the feeding capability of the separating/supplying belt 67. Incidentally, if the separating/supplying belt 67 fails to feed the paper leaves 10, the paper-leaves conveying means 12 and the conveying belt means 43A, 43B of the second paper-leaves conveying means 16 are stopped, and the auxiliary conveying belt means 44A and 44B are reversed at a higher speed for a given period of time to once separate the paper leaf 10 from the belt contact surface 67*a*, and then the feeding operation is again conducted by the separating/supplying belt 67. If this feeding operation fails several times, an alarm is issued to an operator for taking a necessary measure.

(Pattern B)

When the contact 92 is pressed excessively, more than necessary, by the paper leaf 10 at the paper-leaves feeding position 8 and the shade 92*b* enters the interior of the sensor 94, the over-press detecting means 105 detects, on the basis of the output information therefrom, that the paper leaf 10 is pressed excessively at the paper-leaves feeding position 8. Upon this detection, the system control section 100 conducts the feeding operation of the paper leaves 10 through the use of the separating/supplying belt 67 in a state where stopped are the feeding by the paper-leaves conveying means 12 and the conveying belt means 43A, 43B of the second paper-leaves conveying means 16 and the feeding by the auxiliary conveying belt means 44A and 44B. When the feeding of the paper leaves 10 by the separating/supplying belt 67 is accomplished successfully, as with the case of the pattern A, the paper leaves 10 are transferred between the conveying belt means 95*a* and 95*b* to be conveyed to the downstream side while the thickness thereof is detected by the paper-leaves thickness sensor 79 on the way. On the other hand, if the feeding operation of the paper leaves 10 by the separating/supplying belt 67 fails, the higher-speed reverse revolution of the auxiliary conveying belt means 44A and 44B is made for a given period of time in a state where stopped are the paper-leaves conveying means 12 and the conveying belt means 43A, 43B of the second paper-leaves conveying means 16, in order to once separate the paper leaf 10 from the belt contact surface 67*a*, and then the feeding operation by the separating/supplying belt 67 is again conducted. If this feeding operation fails several times, an alarm is issued to the operator for taking a necessary measure.

(Pattern C)

In a case in which, although the paper leaf 10 arrives at the paper-leaves feeding position 8, the paper leaf 10 shifts so that the paper-leaves detecting means 106 cannot detect the paper leaf 10 because it does not press the contact 92 but the paper leaf 10 comes into contact with the auxiliary contact surface 80, the negative pressure in the interior of the suction duct 84*a* of the separation auxiliary device 64 exceeds a specified value. For this reason, when the negative pressure detected by the negative pressure sensor 87 is below the specified value, a decision is made that the paper leaf 10 does not arrive at the paper-leaves feeding position 8 yet, and the separating/supplying belt 67 and the vacuum pump 78 are placed in the stand-by condition. On the other hand, when the negative pressure exceeds the specified value, a decision is made that the paper leaf 10 exists thereat. Accordingly, the feeding is conducted by the separating/supplying belt 67 in a state where stopped are the feeding by the paper-leaves conveying means 12 and the conveying belt means 43A, 43B of the second paper-leaves conveying means 16 and the feeding by the auxiliary conveying belt means 44A and 44B. Following this, as in the case of the pattern A, the paper leaf 10 is sent between the conveying belt means 95*a* and 95*b* and further conveyed to the downstream side while the thickness thereof is measured by the paper-leaves thickness sensor 79 on the way. The other operation is the same as that in the pattern A.

In the above description of the embodiment, although the second paper-leaves conveying means 16 is composed of the conveying belt means 43A, 43B and the auxiliary conveying belt means 44A, 44B, and the auxiliary conveying belt means 44A, 44B are revolved in the reverse direction, it is also acceptable that the conveying belt means 43A, 43B are designed to be revolvable in the forward and reverse directions so that the auxiliary conveying belt means 44A, 44B are omitted.

As described above, in accordance with the present invention, in paper-leaves conveying means for conveying a plurality of paper leaves, set together in a bundle in a depositing section, toward a paper-leaves feeding position where a separating/supplying belt is located so that the paper leaves conveyed are separated and fed one by one, an arm is provided to move toward the paper-leaves feeding position in a protruding condition into the interior of the depositing section for supporting side surfaces of the paper leaves, and to retreat instantaneously from the interior of the depositing section immediately before the last paper leaf existing between the arm and the separating/supplying belt is handed over to the separating/supplying belt side. With this construction, it is possible to eliminate the occurrence of the inclination and falling-down of the paper leaves at the paper-leaves feeding position immediately before the paper leaves are handed over to the separating/supplying belt. This eliminates the work needed in the conventional apparatus, that is, the work for raising the paper leaves inclined backwardly and falling down at the separating/supplying position or supporting the paper leaves by hand up to the paper-leaves feeding position, thus providing a paper-leaves transferring apparatus having great effects, such as lightening the burden on work and avoiding the problem in safety and decreasing the number of full-time operators. In addition, since the arm transferring speed is maintainable at a desired speed until the arm retreats, it is possible to keep constant the density of the paper leaves existing before the paper-leaves feeding position, thereby enabling smooth separation and feeding of the paper leaves and eliminating the simultaneous feeding of two paper leaves.

Furthermore, in accordance with the present invention, when the paper leaves are pressed excessively against the separating/supplying belt side at the paper-leaves feeding position, over-press detecting means detects this fact that, and the conveying direction of the paper leaves by the paper-leaves conveying means is temporarily switched to the opposite direction. With this construction, for example, even if the paper-leaves conveying speed for when the paper leaves are conveyed to the paper-leaves feeding position becomes higher than the speed for when the paper leaves are fed through the separating/supplying belt to the downstream side to cause the paper leaves jam at the paper-leaves feeding position so that the excessively pressed condition of the preceding paper leaves against the belt surface side occurs due to the succeeding paper leaves, the paper leaves can be returned to the upstream side on the conveyance to cancel the excessively pressed condition and then the paper leaves can be fed again. Accordingly, it is possible to provide a paper-leaves division system with great effects, such as reducing the load the preceding paper leaves receive from the succeeding paper leaves and achieving smooth feeding of the paper leaves through the separating/supplying belt at the paper-leaves feeding position.

In addition, since the thickness of the paper leaves fed from the paper-leaves feeding position by means of the separating/supplying belt is detected to implement the feedback control so that the speed at which the paper-leaves conveying means conveys the paper leaves to the paper-leaves feeding position is corrected on the basis of the thickness thereof, it is possible to set the contact force between the paper leaves to below a predetermined value at the paper-leaves feeding position, thus enabling feeding the paper leaves through the separating/supplying belt in a stably attached condition. That is, it is possible to prevent the paper leaves from existing in a high-density condition at the paper-leaves feeding position and to prevent abnormal over-press condition of the paper leaves; therefore, the overlap transportation occurring when the succeeding paper leaves are excessively pressed against the preceding paper leaves is aviodable because of always conveying the paper leaves from the depositing area to the paper-leaves feeding position by a volume corresponding to the thickness of the paper leaves fed. This can provide a paper-leaves separating/supplying apparatus having great effects, such as smoothly feeding the paper leaves without the occurrence of wasteful time at the separation/feeding.

It should be understood that the present invention is not limited to the above-described embodiment, and that it is intended to cover all changes and modifications of the embodiment of the invention herein which do not constitute departures from the spirit and scope of the invention.

What is claimed is:

1. A paper-leaves transferring apparatus comprising:

a separating/supplying belt located at a paper-leaves feeding position for separating a plurality of paper leaves conveyed and feeding said paper leaves one by one; and paper-leaves conveying means for conveying said plurality of paper leaves, set together in a bundle in a depositing section, toward said paper-leave feeding position, said paper-leaves conveying means comprising:

an arm made to be moved toward said paper-leaves feeding position in a protruding condition into the interior of said depositing section while supporting side surfaces of said paper leaves;

an arm protrusion cam placed along a passage for said arm to said paper leaves for protruding said arm into the interior of said depositing section;

means for holding said arm protruded by said arm protrusion cam; and means for retreating said arm from the interior of said depositing section immediately before the last paper leaf of said plurality of paper leaves existing in front of said separating/supplying belt is handed over to said separating/supplying belt is handed over to said separating/supplying belt side.

2. The paper-leaves transferring apparatus according to claim 1, wherein said paper-leaves conveying means further comprises:

a partitioning arm device having means for maintaining said arm in a direction of the protrusion/retreat thereof and making a connection between said arm and said cam means to conduct the protrusion/retreat of said arm along said cam surface of said cam means; and means for holding and conveying a plurality of partitioning arm devices, each corresponding to the first-mentioned partitioning arm device, in a scattered condition, said means for holding and conveying said arm devices being made to move circularly together with said partitioning arm devices for repeatedly making movement of said arm in a direction to said paper-leaves feeding position and movement of said arm in a direction separating from said paper-leaves feeding position.

* * * * *